US006576828B2

(12) United States Patent
Aoki et al.

(10) Patent No.: US 6,576,828 B2
(45) **Date of Patent: *Jun. 10, 2003**

(54) AUTOMATIC COMPOSITION APPARATUS AND METHOD USING RHYTHM PATTERN CHARACTERISTICS DATABASE AND SETTING COMPOSITION CONDITIONS SECTION BY SECTION

(75) Inventors: Eiichiro Aoki, Hamamatsu (JP); Toshio Sugiura, Hamamatsu (JP)

(73) Assignee: Yamaha Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/405,235

(22) Filed: Sep. 24, 1999

(65) Prior Publication Data

US 2002/0007722 A1 Jan. 24, 2002

(30) Foreign Application Priority Data

Sep. 24, 1998 (JP) ..... 10-270029

(51) Int. Cl.[7] ..... G10H 1/40; G10H 7/00
(52) U.S. Cl. ..... 84/635
(58) Field of Search ..... 84/609–614, 634–638, 84/649–652, 666–669, DIG. 12

(56) References Cited

U.S. PATENT DOCUMENTS 4,299,154 A * 11/1981 Dietrich et al. ..... 84/611 X
4,872,385 A * 10/1989 Oguri et al. ..... 84/635
5,099,740 A 3/1992 Minamitaka ..... 84/651
5,363,735 A * 11/1994 Kondo ..... 84/635 X
5,369,217 A * 11/1994 Yamashita et al. ..... 84/611
5,375,501 A * 12/1994 Okuda ..... 84/611
5,486,646 A * 1/1996 Yamashita et al. ..... 84/635
5,521,327 A * 5/1996 Kay et al. ..... 84/635
5,635,659 A * 6/1997 Miyamoto ..... 84/635
5,736,663 A 4/1998 Aoki et al. ..... 84/609
5,756,917 A * 5/1998 Watanabe et al. ..... 84/635 X
5,859,379 A * 1/1999 Ichikawa ..... 84/611 X
5,920,025 A * 7/1999 Itoh et al. ..... 84/611
6,028,262 A * 2/2000 Minamitaka ..... 84/611
6,051,770 A * 4/2000 Milburn et al. ..... 84/611

FOREIGN PATENT DOCUMENTS

JP 9-50278 2/1997

* cited by examiner

*Primary Examiner*—Jeffrey Donels
(74) *Attorney, Agent, or Firm*—Rossi & Associates

(57) ABSTRACT

Automatic composition apparatus and method are provided which are capable of modifying a rhythm pattern to provide a wide variety of rhythm patterns only through simple setting, and a storage medium that accomplishes this function is provided. Characteristics of a rhythm pattern of a piece of music to be composed are established. Characteristic data that match the established characteristics are retrieved from a rhythm pattern database rhythm pattern database comprising a plurality of rhythm patterns and characteristic data indicating characteristics of each of the rhythm patterns. One of the rhythm patterns is selected, that corresponds to the retrieved characteristic data. Accordingly, different rhythm patterns having the same characteristics can be easily obtained. Further, composition conditions to be applied to a whole piece of music to be composed are established, and the established composition conditions are allocated to each of sectional elements that constitute the piece of music, for example, a passage, a phrase, or a measure, and the composition conditions for the whole piece of music, in other words, distributed among the respective passages, phrases or measures. Therefore, a rhythm pattern having different characteristics may be obtained by changing only the characteristics of the whole piece of music, thus assuring an improved efficiency with which the user operates the apparatus.

14 Claims, 26 Drawing Sheets

FIG.6

| | | INITIAL TONE LENGTH | | | SYNCOPATION | | BOUNCE | | SENSE OF ENDING | | COMPLEXNESS | | INDICATION WITH SIXTEENTH NOTES | |
|---|---|---|---|---|---|---|---|---|---|---|---|---|---|---|
| | | LONG | MEDIUM | SHORT | 8 | 16 | 8 | 16 | 8 | 16 | 8 | 16 | | |
| 0 | | | | ○ | ○ | ○ | | | ○ | ○ | 0 | 0 | 0 | |
| 1 | | | | ○ | | | | | ○ | ○ | 0 | 1 | 1 | |
| 2 | | | | ○ | ○ | ○ | | | | | 1 | 3 | 2 | |
| 3 | | | | ○ | | ○ | | | | | 1 | 2 | 3 | |
| 4 | | | | ○ | | | ○ | ○ | | | 1 | 3 | 4 | |
| 5 | | | | ○ | | | | | ○ | ○ | 0 | 1 | 5 | |
| ⋮ | | | | | | | | | | | | | ⋮ | |
| 20 | | | ○ | | | | | | | | 0 | 0 | 20 | |
| 21 | | | ○ | | | | ○ | ○ | | | 0 | 0 | 21 | |
| 22 | | | ○ | | ○ | ○ | | | | | 0 | 1 | 22 | |
| 23 | | | ○ | | ○ | ○ | | | | | 0 | 2 | 23 | |
| 24 | | | ○ | | | ○ | | | | | 1 | 3 | 24 | |
| 25 | | ○ | ○ | | ○ | ○ | ○ | ○ | | | 0 | 3 | 25 | |
| ⋮ | | | | | | | | | | | | | ⋮ | |
| 66 | | | ○ | ○ | | | | | | | 0 | 1 | 66 | |
| 67 | | | ○ | ○ | | | | | | | 0 | 1 | 67 | |
| 68 | | | ○ | ○ | ○ | ○ | | | | | 0 | 0 | 68 | |
| 69 | | | ○ | ○ | | | | | | | 0 | 0 | 69 | |

*FIG.9*

| | |
|---|---|
| OLD RHYTHM PATTERN | |
| EXAMPLE OF NEW RHYTHM PATTERN WHEN INITIAL TONE=LONG SYNCOPATION=OFF BOUNCE=OFF | |
| EXAMPLE OF NEW RHYTHM PATTERN WHEN INITIAL TONE=MEDIUM SYNCOPATION=OFF BOUNCE=OFF | |
| EXAMPLE OF NEW RHYTHM PATTERN WHEN INITIAL TONE=SHORT SYNCOPATION=OFF BOUNCE=OFF | |
| EXAMPLE OF NEW RHYTHM PATTERN WHEN INITIAL TONE=LONG SYNCOPATION=ON BOUNCE=OFF | |
| EXAMPLE OF NEW RHYTHM PATTERN WHEN INITIAL TONE=LONG SYNCOPATION=OFF BOUNCE=ON | |

*FIG.11*

| OLD RHYTHM PATTERN | |
|---|---|
| EXAMPLE OF NEW RHYTHM PATTERN WHEN INITIAL TONE=LONG SYNCOPATION=OFF BOUNCE=OFF | |
| EXAMPLE OF NEW RHYTHM PATTERN WHEN INITIAL TONE=MEDIUM SYNCOPATION=OFF BOUNCE=OFF | |
| EXAMPLE OF NEW RHYTHM PATTERN WHEN INITIAL TONE=SHORT SYNCOPATION=OFF BOUNCE=OFF | |
| EXAMPLE OF NEW RHYTHM PATTERN WHEN INITIAL TONE=LONG SYNCOPATION=ON BOUNCE=OFF | |
| EXAMPLE OF NEW RHYTHM PATTERN WHEN INITIAL TONE=LONG SYNCOPATION=OFF BOUNCE=ON | |

*FIG.16A*

| | SET LEVEL = 0 | SET LEVEL = 1 | SET LEVEL = 2 | SET LEVEL = 3 |
|---|---|---|---|---|
| PASSAGES TO WHICH COMPOSITION CONDITIONS MAY BE APPLIED | ALL OFF | ON/OFF AT RANDOM | ALL ON | ALL ON |
| PHRASES TO WHICH COMPOSITION CONDITIONS MAY BE APPLIED | ALL OFF | ON/OFF AT RANDOM | ALL ON | ALL ON |
| MEASURES TO WHICH COMPOSITION CONDITIONS MAY BE APPLIED | ALL OFF | ON/OFF AT RANDOM | ON/OFF AT RANDOM | ALL ON |

FIG.16B

| | [A] 1ST PASSAGE | | | | [A'] 2ND PASSAGE | | | | [B] 3RD PASSAGE | | | | [C] 4TH PASSAGE | | | |
|---|---|---|---|---|---|---|---|---|---|---|---|---|---|---|---|---|
| | 1ST PHRASE | | 2ND PHRASE | | 1ST PHRASE | | 2ND PHRASE | | 1ST PHRASE | | 2ND PHRASE | | 1ST PHRASE | | 2ND PHRASE | |
| | 1M | 2M | 1M | 2M | 1M | 2M | 1M | 2M | 1M | 2M | 1M | 2M | 1M | 2M | 1M | 2M |
| INITIAL TONE LENGTH | L | S | L | S | L | S | L | S | M | M | M | M | S | S | S | S |
| SYNCOPATION | ON | ON | ON | | ON | ON | ON | | | | | | ON | | ON | |
| BOUNCE (DOTTED NOTE) | | | | | | | | | ON | ON | ON | ON | | | | |
| SENSE OF ENDING | | ON | | ON | | ON | | ON | | ON | | ON | | ON | | ON |
| COMPLEXNESS | 0 | 0 | 0 | 0 | 0 | 0 | 0 | 0 | 0 | 0 | 0 | 0 | 0 | 0 | 0 | 0 |
| ANACRUSIS | ON | | ON | | ON | | ON | | | | | | ON | | ON | |

1M : 1ST MEASURE 2M : 2ND MEASURE L : LONG S : SHORT M : MEDIUM

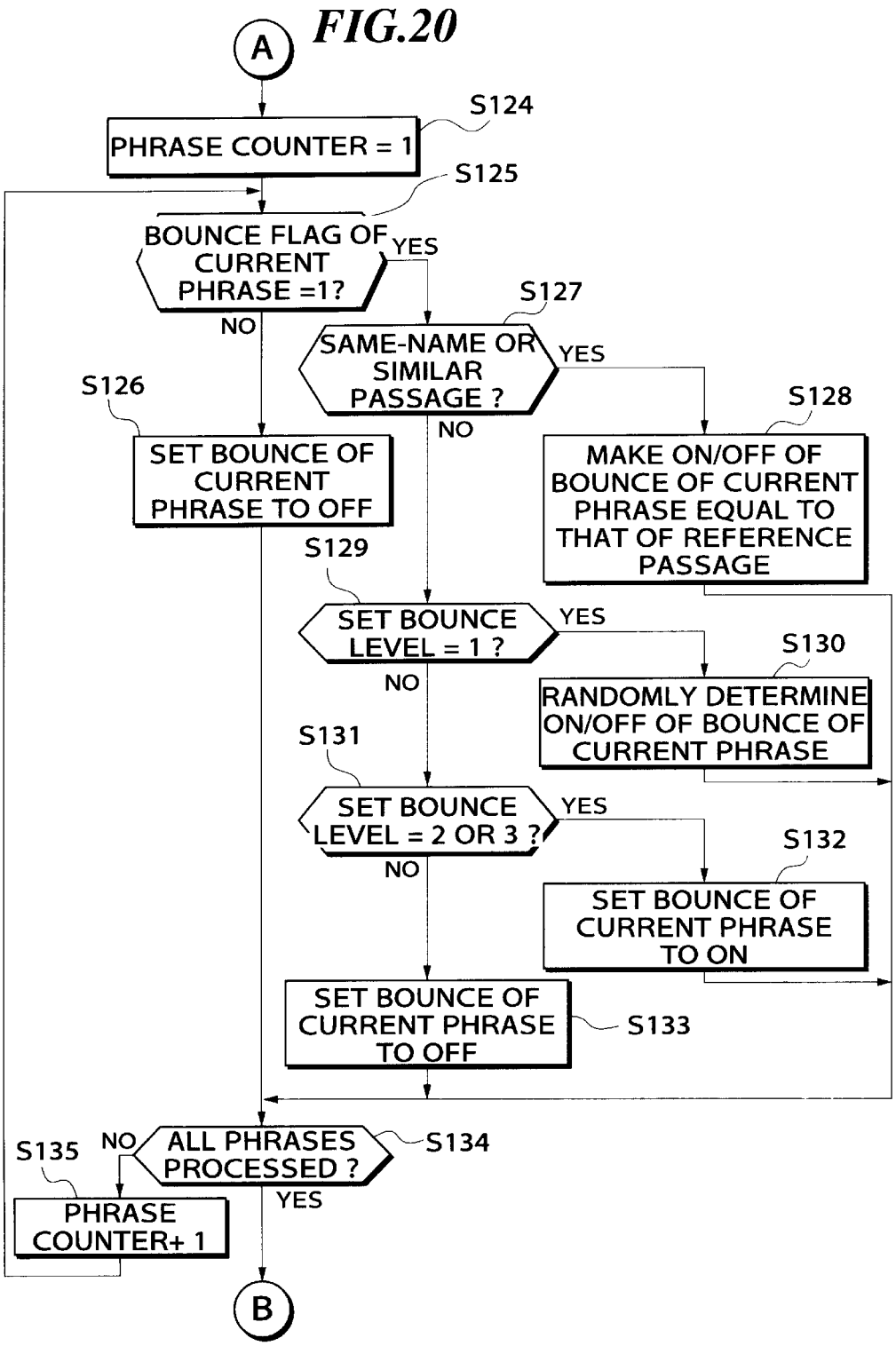
FIG.20
A
S124
PHRASE COUNTER = 1
S125
BOUNCE FLAG OF CURRENT PHRASE =1?
YES
NO
S127
SAME-NAME OR SIMILAR PASSAGE ?
YES
NO
S126
SET BOUNCE OF CURRENT PHRASE TO OFF
S128
MAKE ON/OFF OF BOUNCE OF CURRENT PHRASE EQUAL TO THAT OF REFERENCE PASSAGE
S129
SET BOUNCE LEVEL = 1 ?
YES
NO
S130
RANDOMLY DETERMINE ON/OFF OF BOUNCE OF CURRENT PHRASE
S131
SET BOUNCE LEVEL = 2 OR 3 ?
YES
NO
S132
SET BOUNCE OF CURRENT PHRASE TO ON
SET BOUNCE OF CURRENT PHRASE TO OFF
S133
S135
NO
ALL PHRASES PROCESSED ?
S134
YES
PHRASE COUNTER+ 1
B

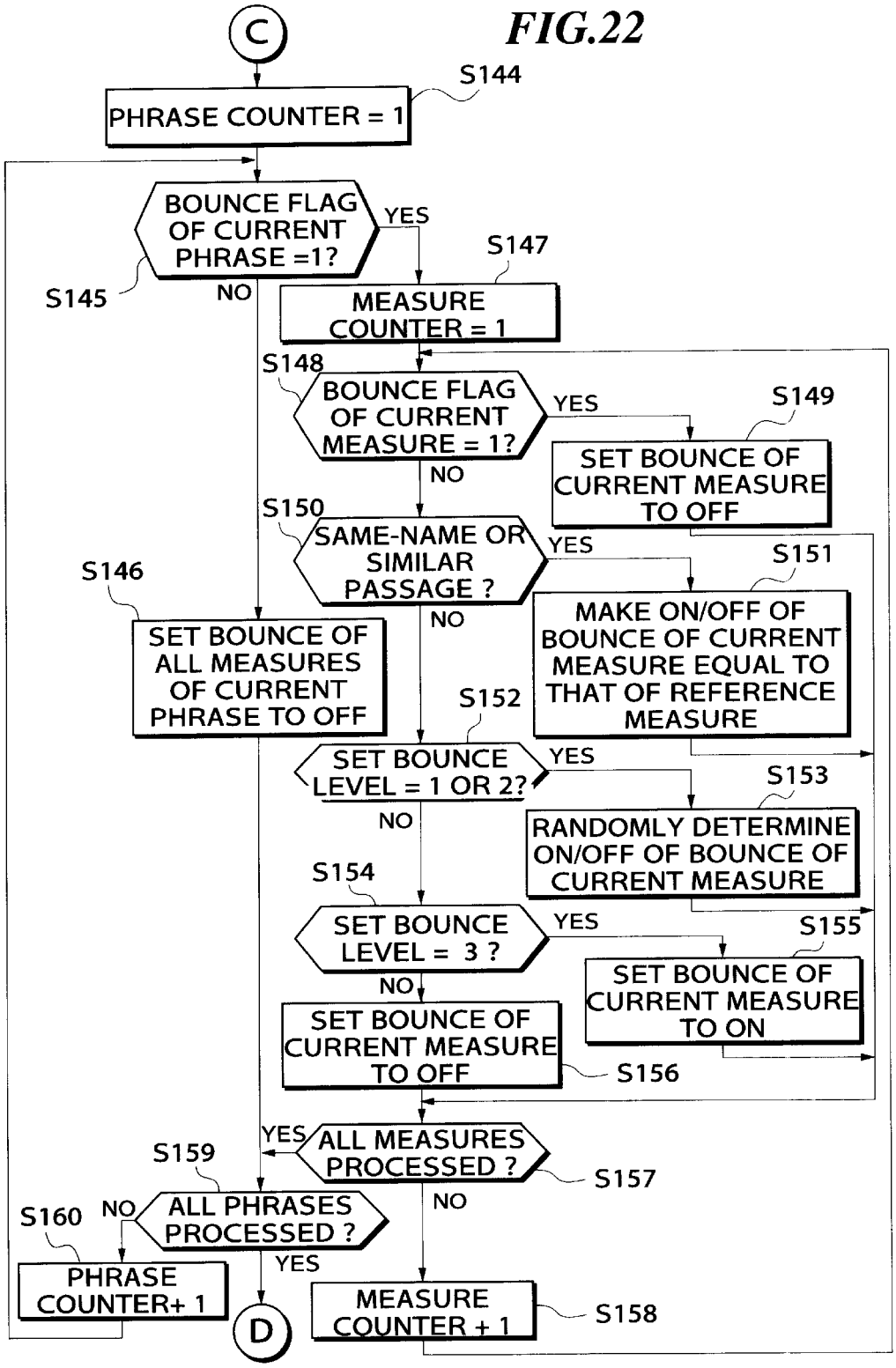
FIG.22
C
S144
PHRASE COUNTER = 1
BOUNCE FLAG OF CURRENT PHRASE =1?
YES
S147
S145
NO
MEASURE COUNTER = 1
S148
BOUNCE FLAG OF CURRENT MEASURE = 1?
YES
S149
SET BOUNCE OF CURRENT MEASURE TO OFF
NO
S150
SAME-NAME OR SIMILAR PASSAGE ?
YES
S151
S146
MAKE ON/OFF OF BOUNCE OF CURRENT MEASURE EQUAL TO THAT OF REFERENCE MEASURE
NO
SET BOUNCE OF ALL MEASURES OF CURRENT PHRASE TO OFF
S152
SET BOUNCE LEVEL = 1 OR 2?
YES
S153
NO
RANDOMLY DETERMINE ON/OFF OF BOUNCE OF CURRENT MEASURE
S154
SET BOUNCE LEVEL = 3 ?
YES
S155
NO
SET BOUNCE OF CURRENT MEASURE TO ON
SET BOUNCE OF CURRENT MEASURE TO OFF
S156
YES
ALL MEASURES PROCESSED ?
S157
S159
S160
NO
ALL PHRASES PROCESSED ?
NO
YES
PHRASE COUNTER+ 1
D
MEASURE COUNTER + 1
S158

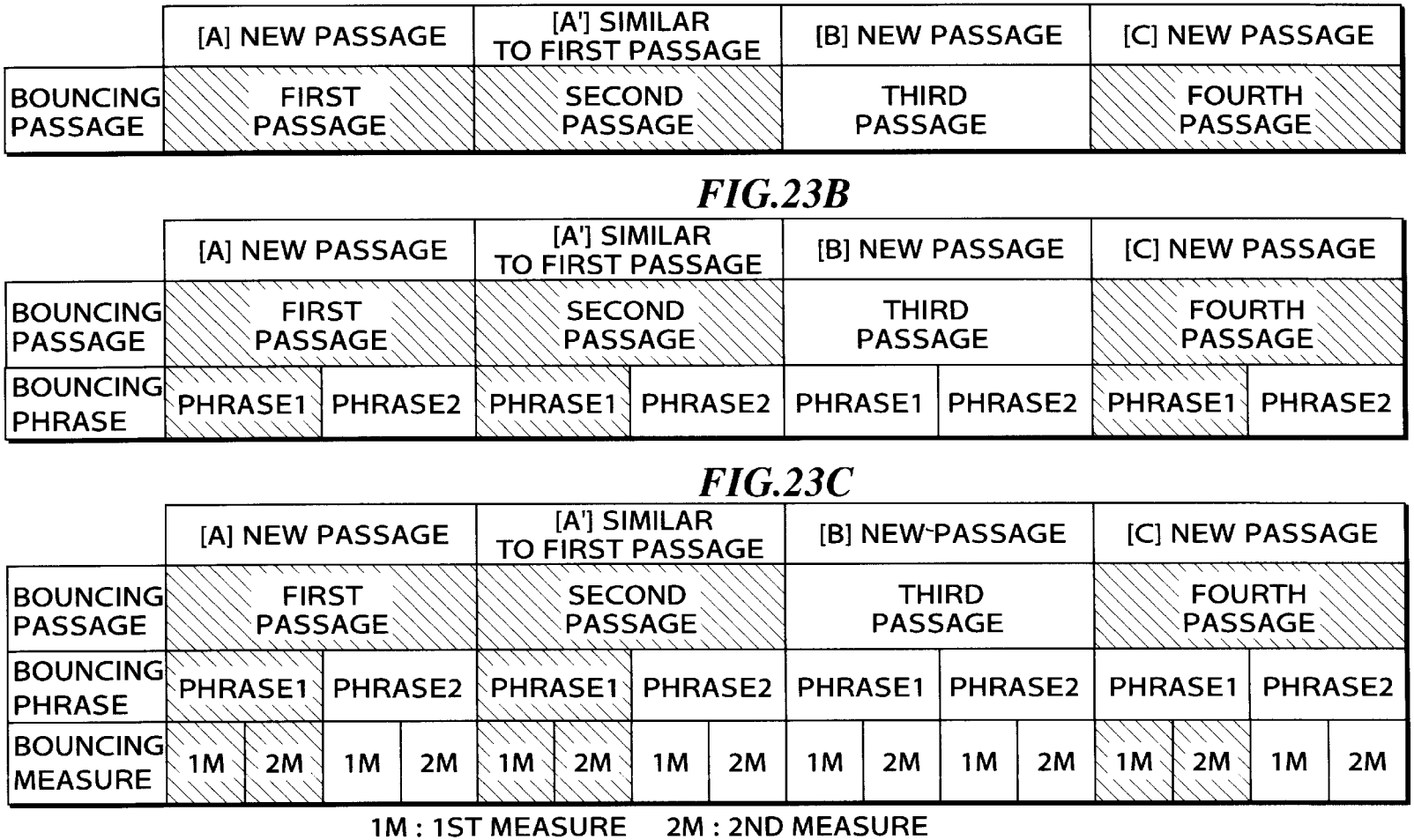
FIG.23A
BOUNCING PASSAGE
[A] NEW PASSAGE
[A'] SIMILAR TO FIRST PASSAGE
[B] NEW PASSAGE
[C] NEW PASSAGE
FIRST PASSAGE
SECOND PASSAGE
THIRD PASSAGE
FOURTH PASSAGE
FIG.23B
BOUNCING PASSAGE
BOUNCING PHRASE
[A] NEW PASSAGE
[A'] SIMILAR TO FIRST PASSAGE
[B] NEW PASSAGE
[C] NEW PASSAGE
FIRST PASSAGE
SECOND PASSAGE
THIRD PASSAGE
FOURTH PASSAGE
PHRASE1
PHRASE2
PHRASE1
PHRASE2
PHRASE1
PHRASE2
FIG.23C
BOUNCING PASSAGE
BOUNCING PHRASE
BOUNCING MEASURE
[A] NEW PASSAGE
[A'] SIMILAR TO FIRST PASSAGE
[B] NEW-PASSAGE
[C] NEW PASSAGE
FIRST PASSAGE
SECOND PASSAGE
THIRD PASSAGE
FOURTH PASSAGE
PHRASE1
PHRASE2
PHRASE1
PHRASE2
PHRASE1
PHRASE2
1M
2M
1M
2M
1M
2M
1M
2M
1M
2M
1M
2M
1M : 1ST MEASURE 2M : 2ND MEASURE

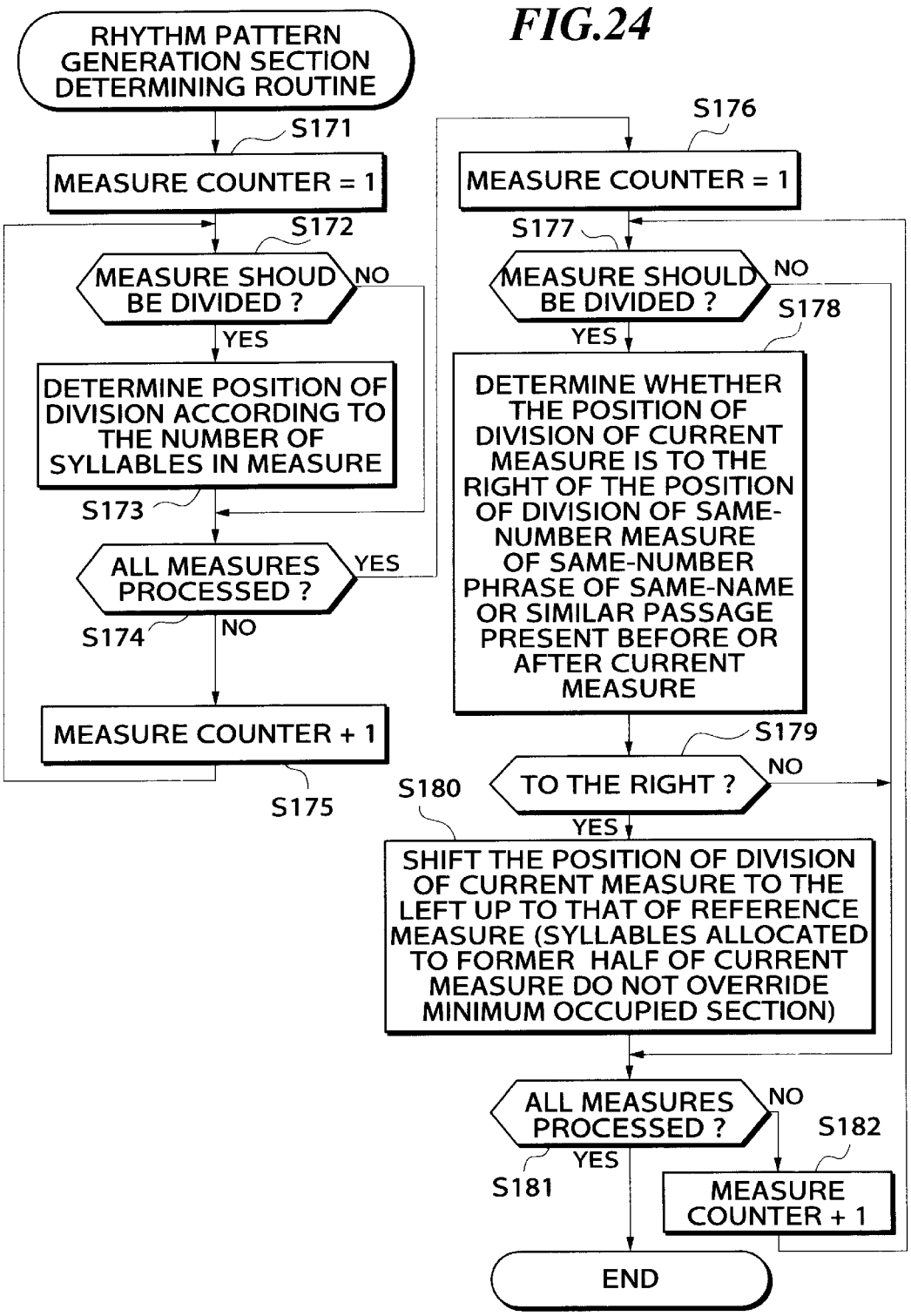
FIG.24
RHYTHM PATTERN GENERATION SECTION DETERMINING ROUTINE
S171
MEASURE COUNTER = 1
S172
MEASURE SHOUD BE DIVIDED ?
NO
YES
DETERMINE POSITION OF DIVISION ACCORDING TO THE NUMBER OF SYLLABLES IN MEASURE
S173
ALL MEASURES PROCESSED ?
YES
S174
NO
MEASURE COUNTER + 1
S175
S176
MEASURE COUNTER = 1
S177
MEASURE SHOULD BE DIVIDED ?
NO
S178
YES
DETERMINE WHETHER THE POSITION OF DIVISION OF CURRENT MEASURE IS TO THE RIGHT OF THE POSITION OF DIVISION OF SAME-NUMBER MEASURE OF SAME-NUMBER PHRASE OF SAME-NAME OR SIMILAR PASSAGE PRESENT BEFORE OR AFTER CURRENT MEASURE
S179
TO THE RIGHT ?
NO
S180
YES
SHIFT THE POSITION OF DIVISION OF CURRENT MEASURE TO THE LEFT UP TO THAT OF REFERENCE MEASURE (SYLLABLES ALLOCATED TO FORMER HALF OF CURRENT MEASURE DO NOT OVERRIDE MINIMUM OCCUPIED SECTION)
ALL MEASURES PROCESSED ?
NO
S182
YES
S181
MEASURE COUNTER + 1
END

AUTOMATIC COMPOSITION APPARATUS AND METHOD USING RHYTHM PATTERN CHARACTERISTICS DATABASE AND SETTING COMPOSITION CONDITIONS SECTION BY SECTION

BACKGROUND OF THE INVENTION

1. Field of the Invention

The present invention relates to an automatic composition apparatus and a method for automatically composing a piece of music according to various conditions relating to music, and a storage medium that stores a program to be executed for automatically composing a piece of music.

2. Prior Art

A known automatic composition apparatus for automatically composing a piece of music according to various conditions relating to music is disclosed in, for example, laid-open Japanese Patent Publication (Kokai) No. 9-50278 and corresponding U.S. Pat. No. 5,736,663.

The automatic composition apparatus disclosed in the above-identified publication is adapted to analyze and extract musical features of an already-composed piece of music, and store the results of the analyzing and extracting process as a music template in a performance data memory. The known apparatus enables the user to suitably modify a music template selected from various music templates stored in the memory, thereby to automatically compose a piece of music based on the template that has been modified.

The data contained in the music template include those related to the rhythm of each phrase, including "density pattern (density)", "the presence of a rest at the head of a phrase (phrase head delay designation", "passage to be contrasted or imitated (contrast/imitation)", "the presence of syncopation (designation of syncopation)" and so on. A beat priority setting table that determines the order of priority in which notes are allocated is created on the basis of the above data, and the tone generation timing of each syllable, namely, a rhythm pattern, is determined according to the beat priority setting table, and the number of syllables contained in the measure in question.

In the known automatic composition apparatus as described above, however, the rhythm pattern is determined based on the beat priority setting table that is uniformly determined according to data relating to the rhythm of each phrase indicated in the musical template, and therefore similar rhythm patterns are highly likely to be generated if similar characteristics are set in the musical template.

In order to modify the rhythm pattern, it is necessary to set the value of each of the above-indicated data, i.e., "density pattern (density)", "the presence of a rest at the head of a phrase (phrase head delay designation", "passage to be contrasted or imitated (contrast/imitation)", "the presence of syncopation (designation of syncopation)" and so on, with respect to each of all phrases, thus requiring the user to perform cumbersome setting operations.

Furthermore, a considerably complicated algorithm is used for analyzing and extracting musical characteristics of an already-composed piece of music so as to produce a musical template, which requires an increased programming time and increased programming capacity, resulting in an increased manufacturing cost.

Moreover, the known automatic composition apparatus is not able to generate a rhythm pattern for a pickup measure (a measure that has a leading part thereof included in the previous measure), and thus fails to meet the user's demand for creating an rhythm pattern(s) for a piece of music containing a pickup measure(s).

SUMMARY OF THE INVENTION

It is therefore the first object of the present invention to provide automatic composition apparatus and method capable of modifying a rhythm pattern to provide a wide variety of rhythm patterns only through simple setting, and a storage medium that accomplishes this function.

The second object of the present invention is to provide automatic composition apparatus and method, and storage medium that are able to easily extract musical features of an already-composed piece of music, for example, when a piece of music is composed.

The third object of the present invention is to provide automatic composition apparatus and method, and storage medium capable of generating a rhythm pattern(s) for a piece of music including a singular measure(s) such as a pickup measure(s).

To accomplish the first object, the present invention provides an automatic composition apparatus comprising a rhythm pattern database comprising a plurality of rhythm patterns and characteristic data indicating characteristics of each of the rhythm patterns, a setting device that establishes characteristics of a rhythm pattern of a piece of music to be composed, and a selecting device that retrieves the characteristic data that match the characteristics established by the setting device, from the rhythm pattern database, and selects one of the rhythm patterns that corresponds to the retrieved characteristic data.

To accomplish the first object, the present invention provides an automatic composition method comprising the steps of providing a rhythm pattern database comprising a plurality of rhythm patterns and characteristic data indicating characteristics of each of the rhythm patterns, establishing characteristics of a rhythm pattern of a piece of music to be composed, retrieving the characteristic data that match the established characteristics from the rhythm pattern database, and selecting one of the rhythm patterns that corresponds to the retrieved characteristic data.

To accomplish the first object, the present invention provides a storage medium storing program that is executable by a computer, comprising a setting module that establishes characteristics of a rhythm pattern of a piece of music to be composed and, a selecting module that retrieves characteristic data that match the characteristics established by the setting module, from a rhythm pattern database comprising a plurality of rhythm patterns and characteristic data indicating characteristics of each of the rhythm patterns, and selects one of the rhythm patterns that corresponds to the retrieved characteristic data.

With the apparatus, method, and storage medium constructed as described above, characteristic data that match the set characteristics are retrieved from the rhythm pattern database, and a rhythm pattern corresponding to the retrieved characteristic data is selected. Accordingly, different rhythm patterns having the same characteristics can be easily obtained.

To accomplish the first object, the present invention provides an automatic composition apparatus comprising a setting device that establishes composition conditions to be applied to a whole piece of music to be composed, and an allocating device that allocates the composition conditions established by the setting device to each of sectional elements that constitute the piece of music.

To accomplish the first object, the present invention provides an automatic composition method comprising the steps of establishing composition conditions to be applied to a whole piece of music to be composed, and allocating the established composition conditions to each of sectional elements that constitute the piece of music.

To accomplish the first object, the present invention provides a storage medium storing program that is executable by a computer, comprising a setting module that establishes composition conditions to be applied to a whole piece of music to be composed, and an allocating module that allocates the composition conditions established by the setting device to each of sectional elements that constitute the piece of music.

Here, the sectional element may represent, for example, a passage, a phrase, or a measure, and the composition conditions for the whole piece of music are allocated to, or, distributed among the respective passages, phrases or measures.

With the above arrangement, the composition conditions set for the whole piece of music are allocated to the sectional elements that constitute the piece of music, and therefore a rhythm pattern having different characteristics may be obtained by changing only the characteristics of the whole piece of music, thus assuring an improved efficiency with which the user operates the apparatus.

More preferably, the characteristics of each of the rhythm patterns comprise at least information indicating a number of tone-generation points of the each rhythm pattern, and, when the setting device changes the number of tone-generation points in the piece of music to be composed, the selecting device selects, from the rhythm pattern database, a rhythm pattern whose number of tone-generation points is equal to that after being changed, and which has characteristic data indicating at least one characteristic other than the number of tone generation points, which data are approximate to those of an original rhythm pattern before the setting device changes the number of tone-generation points.

With this arrangement, a rhythm pattern that differs from the original rhythm pattern only in terms of the number of tone-generation points can be generated.

To accomplish the second object, the present invention provides an automatic composition apparatus comprising a rhythm pattern database comprising a plurality of rhythm patterns, and characteristic data indicating characteristics of each of the rhythm patterns, an attaching device that attaches a rhythm pattern to a piece of music to be composed, and a determining device that detects a rhythm pattern corresponding to the rhythm pattern to be attached to the piece of music by searching the rhythm pattern database, and determines characteristic data corresponding to the detected rhythm pattern, as characteristic data of the rhythm pattern to be attached to the piece of music.

To accomplish the second object, the present invention provides an automatic composition method comprising the steps of providing a rhythm pattern database comprising a plurality of rhythm patterns, and characteristic data indicating characteristics of each of the rhythm patterns, attaching a rhythm pattern to a piece of music to be composed, and detecting a rhythm pattern corresponding to the rhythm pattern to be attached to the piece of music by searching the rhythm pattern database, and determining characteristic data corresponding to the detected rhythm pattern, as characteristic data of the rhythm pattern to be attached to the piece of music.

To accomplish the second object of the invention, the present invention provides a storage medium storing program that is executable by a computer, comprising a determining module that searches a rhythm pattern database comprising a plurality of rhythm patterns, and characteristic data indicating characteristics of each of the rhythm patterns, so as to detect a rhythm pattern corresponding to a rhythm pattern to be attached to a piece of music to be composed, and determines characteristic data corresponding to the detected rhythm pattern, as characteristic data of the rhythm pattern to be attached to the piece of music.

With the apparatus and storage medium constructed as described above, a rhythm pattern corresponding to a rhythm pattern to be given to a piece of music to be composed is detected or retrieved from the rhythm pattern database, and characteristic data corresponding to the detected rhythm pattern is determined as characteristic data of the rhythm pattern to be given to the piece of music. Thus, musical features of an already-composed piece of music can be easily extracted when a piece of music is composed.

To accomplish the third object, in the automatic composition apparatus according to the present invention, each of the plurality of rhythm patterns stored in the rhythm pattern database represents a rhythm pattern of one measure, the automatic composition apparatus further comprising a measure dividing device that divides a measure in question in the piece of music to be composed into a first section associated with a previous measure that immediately precedes the measure in question, and a second section associated with a measure that immediately follows the measure in question, when a single rhythm pattern cannot be allocated to the measure in question in the piece of music, and wherein the selecting device selects different rhythm patterns for the first section and the second section, respectively.

With the apparatus constructed as described above, rhythm patterns each corresponding to one measure are stored in the rhythm pattern database. Namely, each of the rhythm patterns stored in the rhythm pattern database represents a rhythm pattern of one measure. When a single rhythm pattern cannot be allocated to a certain measure, the measure is divided into the first section associated with the previous measure, and the second section associated with the immediately following measure, and different rhythm patterns are selected for the first and second sections, respectively. It is thus possible to produce rhythm patterns for a piece of music including a singular measure(s) such as a pickup measure(s).

The above and other objects of the invention will become more apparent from the following drawings taken in conjunction with the accompanying drawings.

BRIEF DESCRIPTION OF THE DRAWINGS

FIG. 6 is a view showing exemplary rhythm pattern data that constitute the rhythm pattern database of FIG. 3;

FIG. 9 is a view showing exemplary rhythm patterns determined as new rhythm patterns of a certain measure when the number of tone-generation points is increased;

FIG. 11 is a view showing exemplary rhythm patterns determined as new rhythm patterns of a certain measure when the number of tone-generation points is reduced;

FIG. 16A is a view showing the relationship between the set level and the passage, phrase and measure to which the composition conditions may be applied;

FIG. 16B is a view showing one example of a rhythm pattern characteristic link table;

FIG. 20 is a flowchart showing in detail the flow of a bouncing phrase selecting subroutine of FIG. 17;

FIG. 22 is a flowchart showing in detail the flow of a bouncing measure selecting subroutine of FIG. 17;

FIG. 23A is a table indicating selected bouncing passages;

FIG. 23B is a table indicating selected bouncing phrases;

FIG. 23C is a table indicating selected bouncing passages, bouncing phrases, and bouncing measures;

FIG. 24 is a flowchart showing in detail the flow of a rhythm pattern generation section determining routine of FIG. 5.

DETAILED DESCRIPTION OF THE PREFERRED EMBODIMENT

One preferred embodiment of the present invention will be described in detail with reference to the accompanying drawings.

Figure 1:
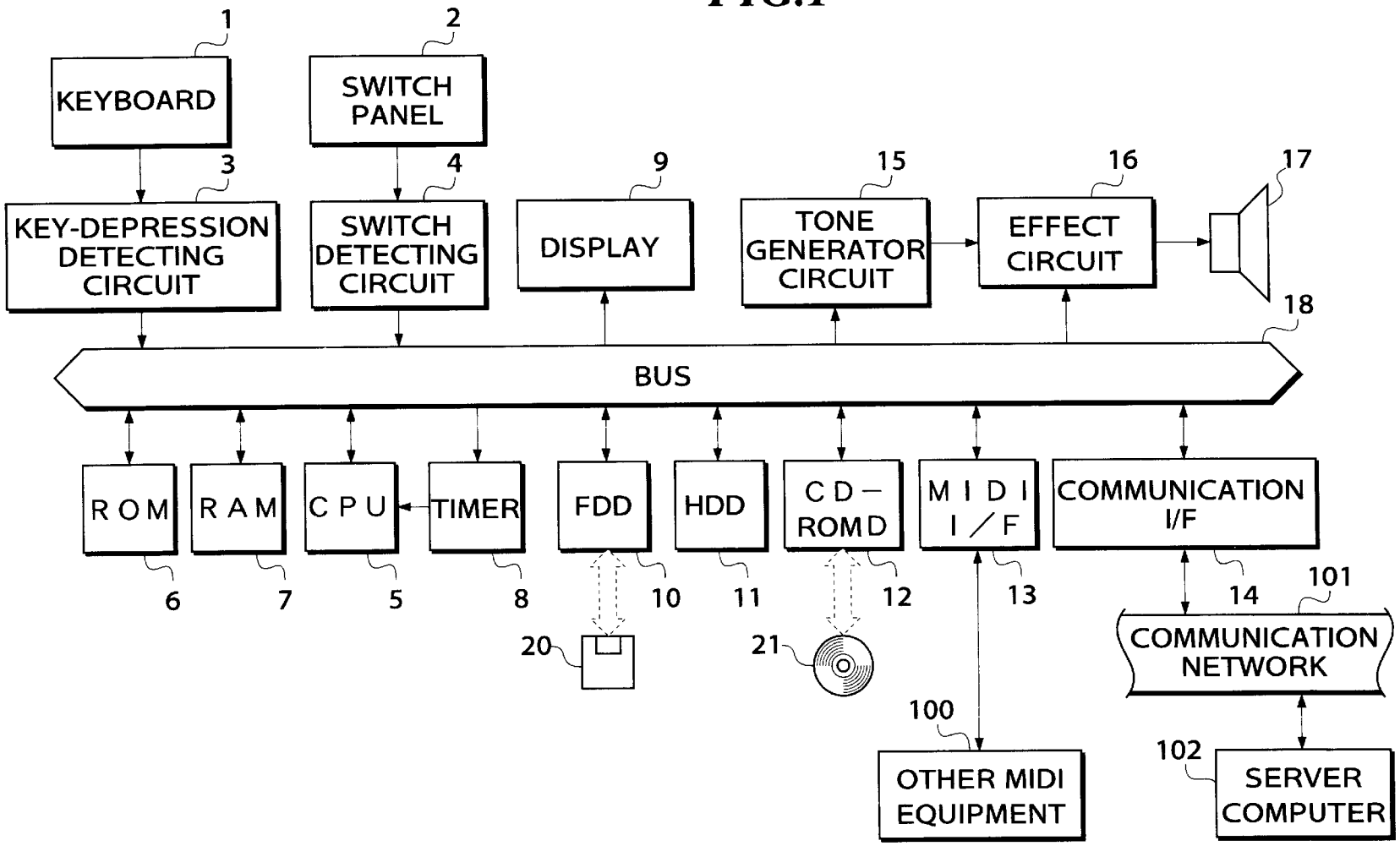
FIG. 1 is a block diagram schematically showing the construction of an automatic composition apparatus according to one embodiment of the present invention.

FIG. 1 is a block diagram schematically showing the construction of an automatic composition apparatus according to one embodiment of the present invention.

As shown in FIG. 1, the automatic composition apparatus of the present embodiment includes a keyboard 1 through which pitch information is entered, a switch panel 2 including a plurality of switches (including a mouse serving as a pointing device) with which various types of information is entered, a key-depression detecting circuit 3 that detects the operated state of each key on the keyboard 1, and a switch detecting circuit 4 that detects the operated or depressed state of each switch on the switch panel 2. The automatic composition apparatus also includes CPU 5 that governs control of the whole apparatus, ROM 6 that stores control programs to be executed by the CPU 5, table data, and so forth, RAM 7 that temporarily stores performance data, various input information, and operation results, and a timer 8 that counts interrupt time during timer interrupt processing, and various periods of time. The present apparatus further includes a display device 9 for displaying various information, which includes, for example, a large-sized liquid crystal display (LCD) or CRT (cathode ray tube) display, and light emitting diodes (LED), a floppy disc drive (FDD) 10 for driving a floppy disc (FD) 20 as one type of storage medium, a hard disc drive (HDD) 11 for driving a hard disc (not shown) that may store various application programs including the above control programs, and various types of data, and a CD-ROM drive (CD-ROMD) 12 for driving a CD-ROM (compact disc-read only memory) 21 that may store various application programs including the above control programs, and various types of data. The apparatus further includes a MIDI interface (I/F) 13 that receives MIDI (Musical Instrument Digital Interface) signals from external devices or equipment, and generates MIDI signals to the external devices or equipment, a communication interface (I/F) 14 that transmits and receives data to and from a server computer 102, or the like, through a communication network 101, a tone generator circuit 15 that converts performance data entered through the keyboard 1, preset performance data, or the like, into musical tone signals, an effect circuit 16 that gives various sound effects to the tone signals received from the tone source circuit 15, and a sound system 17 that converts the tone signals received from the effect circuit 16, into actual sound. The sound system 17 may consist of a DAC (Digital-to-Analog Converter), an amplifier, a loudspeaker, or the like.

In the apparatus of the present embodiment, the components 3–16 as indicated above are connected with each other via a bus 18. In addition, the timer 8 is connected to the CPU 5, and other MIDI equipment 100 is connected to the MIDI I/F 13, while the communication network 101 is connected to the communication I/F 14. Also, the effect circuit 16 is connected to the tone generator circuit 15, and the sound system 17 is connected to the effect circuit 16.

As described above, the hard disc mounted in the HDD 11 may store control programs to be executed by the CPU 5. Where a certain control program is not stored in the ROM 6, the hard disc may store the control program, which is read into the RAM 7 so that the CPU 5 can perform the same operation as in the case where the control program is stored in the ROM 6. In this manner, a new control program can be easily added, or an existing program that has been already installed can be easily upgraded.

A control program or various data may be read from the CD-ROM 21 set in the CD-ROM drive 12, and stored to the hard disc in the HDD 11. In this manner, a new control program can be easily installed, or an existing program can be easily upgraded. The present apparatus may be provided with other external storage devices, such as a magneto-optic disc (MO) device, that utilize various forms of storage media, in addition to or in place of the CD-ROM device 12.

As described above, the communication I/F 14 is connected to the communication network 101, such as LAN (Local Area Network), Internet, or a telephone line, so as to be connected to the server computer 102 via the communication network 101. In the case where a certain program or a certain set of parameters is not stored in the hard disc within the HDD 11, the communication I/F 14 may be used for downloading the program or parameters from the server computer 102. A client computer (i.e., automatic composition apparatus in the present embodiment) sends a command to the server computer 102 via the communication I/F 14 and communication network 101, to request downloading of a desired program or parameters. Upon receipt of the command, the server computer 102 delivers the requested program or set of parameters to the client computer, through the communication network 101. The client computer then receives the program or set of parameters through the communication I/F 14, and stores the same to the hard disc in the HDD 11. In this manner, downloading is accomplished.

It is also possible to provide another interface for transmitting and receiving data directly to and from an external computer, or the like.

Figure 2:
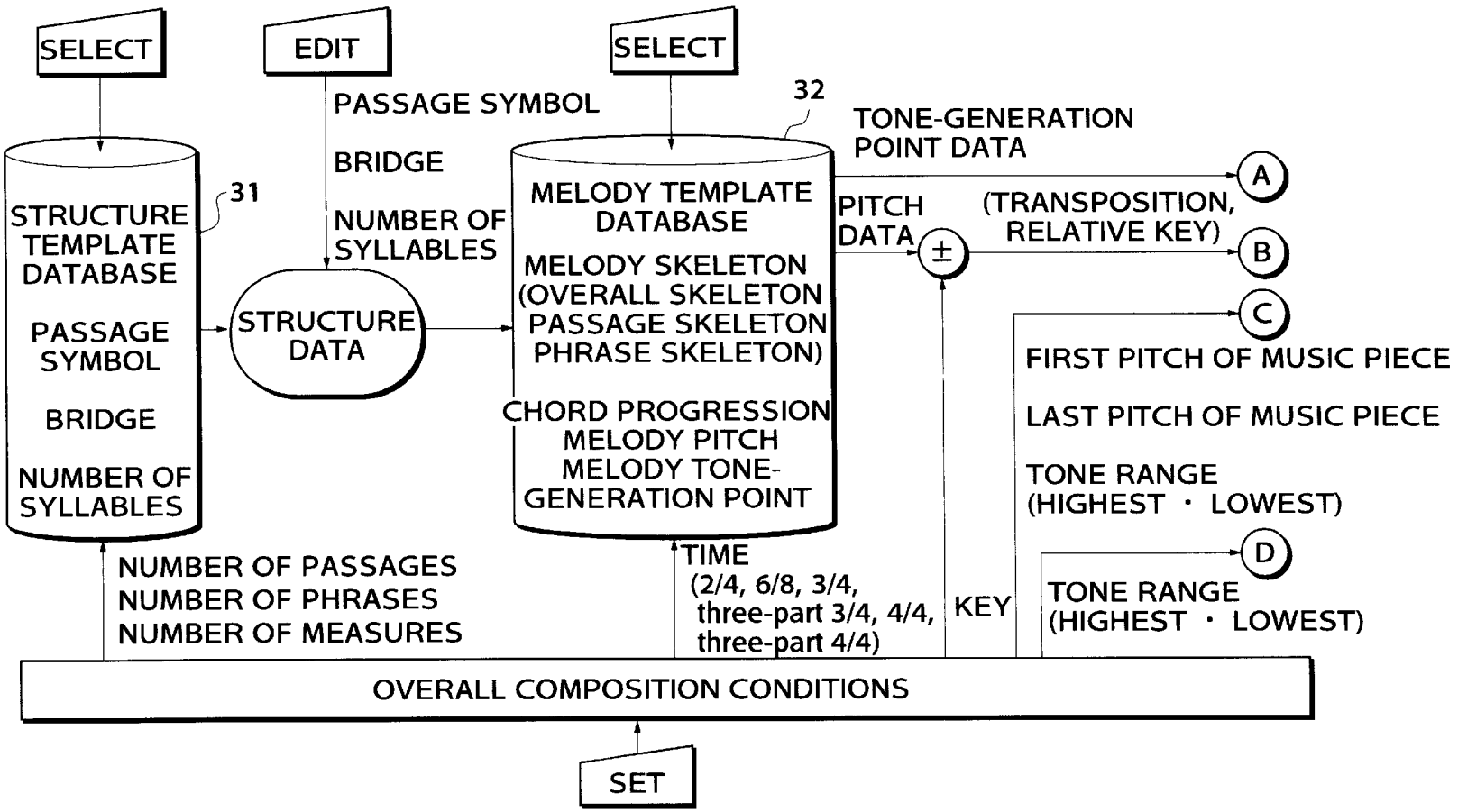
FIG. 2 is a view visually representing control operations performed by the automatic composition apparatus of FIG. 1.
Figure 3:
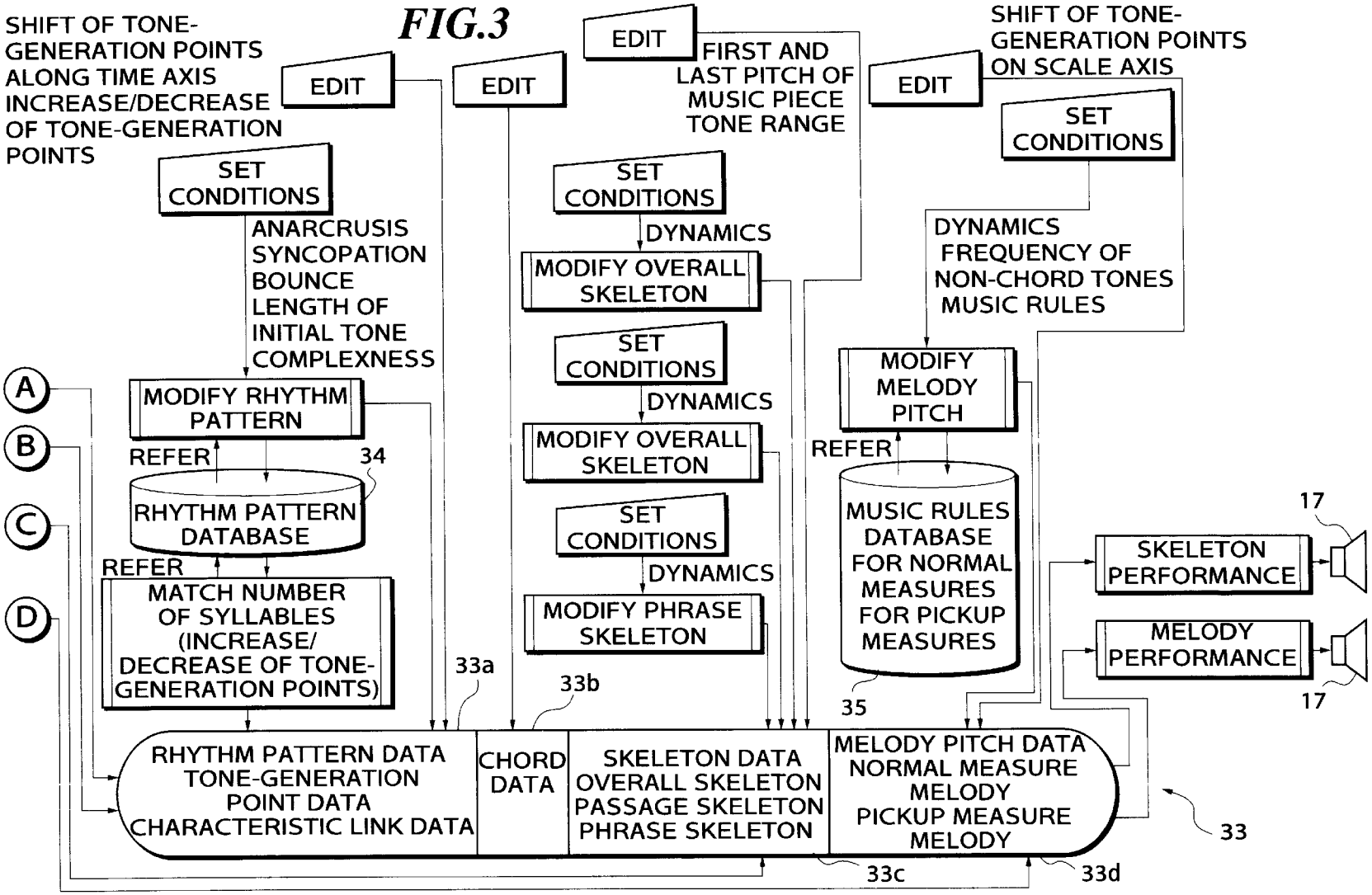
FIG. 3 is a view visually representing further control operations performed by the automatic composition apparatus of FIG. 1.

FIG. 2 and FIG. 3 visually represent various control operations performed by the automatic composition apparatus of the present embodiment. Referring to FIGS. 2 and 3, the summary of the control operations will be now described.

In FIG. 2, the user initially selects one from a plurality of templates each containing a set of overall composition conditions (which templates may be stored in the hard disc as described above), to thereby set or enter a desired set of overall composition conditions contained in the selected template. Items to be set as the overall composition conditions include, for example, the number of passages, the number of phrases, the number of measures, time or meter, key, the first pitch of a piece of music, the last pitch of the music piece, the tone range (defined by the highest tone and the lowest tone), and so forth. Data corresponding to these items are prescribed in advance in each of the templates to which a certain name is given. If the user selects a mode for selecting the overall composition conditions, using the mouse as indicated above, and clicks "overall composition conditions" displayed in this mode, a pop-up menu listing the names of the templates appears on the display screen. If the user selects a desired one of the template names, the overall composition conditions contained in the template corresponding to the selected name are established. It is, however, to be noted that the items of the composition conditions may be individually modified or entered by the user.

Based on the number of passages, the number of phrases and the number of measures, among the overall composition conditions set in the above manner, a structure template that best matches the above conditions is selected and retrieved from a structure template database 31, or a plurality of structure templates matching the above conditions are presented to the user, thus allowing the user to select one of these templates. Here, the structure template database 31 is a database constructed on the hard disc, and consists of a plurality of structure templates. Structure data contained in each structure template include, for example, a passage symbol (that will be described later referring to FIG. 16B) set for each passage, the position of a bridge passage, the number of syllables, and so on. If the structure data of the structure template retrieved from the structure template database 31 is different from the one desired by the user, the user may select a desired one from other candidates, or edit a part of the structure data of the structure template thus retrieved.

A melody template database 32 is then searched based on the thus generated structure data (except the number of syllables) and the time or meter set as one of the overall composition conditions, and a melody template that best matches these conditions is retrieved from the database 32. The melody template database 32 may be constructed on the hard disc, like the structure template database 31, and consists of a plurality of melody templates. Each melody template contains data of each of items including a melody skeleton (that consists of an overall skeleton as the uppermost layer, a passage skeleton as the intermediate layer, and a phrase skeleton as the lowest layer, in the hierarchical structure in the present embodiment), chord progression, pitches, and tone-generation points of a melody. The data contained in each melody template is sufficient as it is (without being modified as described later) to enable performance of a piece of music. If a certain melody template is retrieved from the melody template database 32 as described above, each data contained in the melody template is established (entered). If the selected melody template is different from the one desired by the user, a desired one may be selected from other candidates, as in the case of the structure template.

Once each data contained in the melody template has been entered, pitch data among the data entered is converted into that of a transposed key or relative key, according to the key that was set as one of the overall composition conditions, and the resulting pitch data is supplied to a melody template modifying unit 33 of FIG. 3. The data other than the pitch data are supplied to the melody template modifying unit 33 without being modified.

As shown in FIG. 3, the melody template modifying unit 33 consists of a rhythm pattern data modifying unit 33*a*, a chord data modifying unit 33*b*, a skeleton data modifying unit 33*c*, and a melody pitch data modifying unit 33*d*.

Where the rhythm pattern in the selected melody template is different from the one desired or intended by the user, the rhythm pattern data modifying unit 33*a* generates a rhythm pattern characteristic link table and new tone-generation point data (rhythm pattern data), based on various conditions set by the user, including such items as the presence of anacrusis (unstressed note), the presence of syncopation (designated by a set level as described later), the presence of a bounce (dotted note) (designated by a set level as described later), the length of the initial note, and the level of complexness (easiness/difficulty). The rhythm pattern characteristic link table is constructed by setting data relating to each of the above items, namely, rhythm pattern characteristics, for each measure, and linking a series of the set data over the entire piece of music. The tone-generation point represents a point of time at which a tone of a melody is generated, and the number of tone-generating points in one measure corresponds to the number of syllables in the same measure. Based on each characteristic link data in the rhythm pattern characteristic link table, a rhythm pattern for one measure is retrieved from a rhythm pattern database 34. Then, rhythm pattern data of the whole piece of music is generated by linking or connecting the rhythm patterns of all of the measures in the piece of music.

Also, matching of the number of syllables is performed when the number of syllables set by the user is different from the number of the tone-generation points in the selected melody template (this situation occurs since the information on the number of syllables is not referred to for the retrieval of the melody template), or where the number of syllables set by the user is different from the number of tone-generation points in the rhythm pattern data of the whole piece of music generated as described above. For matching of the number of syllables, a rhythm pattern having the same characteristics as the rhythm pattern in the melody template to be replaced or the rhythm pattern generated as described above but having a different number of syllables is retrieved or selected from the rhythm pattern database 34, so as to effect replacement of the rhythm pattern by the selected one with a result of an increase/decrease in the number of syllables.

The present apparatus is also provided with an edit function that enables the user to perform manual operations for shifting the time axis along which the tone-generation points are distributed, or increasing or reducing the number of the tone-generation points. If the time axis of the tone-generation points is shifted or the number of these points is changed as a result of a manual operation, the rhythm pattern data modifying unit 33*a* modifies corresponding rhythm pattern data.

The chord data modifying unit 33*b* modifies chord data according to an edit command or instructions of the user, when the chord progression in the selected melody template is different from the one desired by the user.

The skeleton data modifying unit 33*c* performs individual modifying operations with respect to the respective layers of skeleton data contained in the selected melody template, and also performs the overall editing operation with respect to all layers of skeleton data.

The melody pitch data modifying unit 33*d* modifies melody pitch data of the selected melody template, based on dynamics set by the user, the frequency of non-chord tones, and musical rules, while referring to a musical rule database 35. If the user manually enters a command for a scale-axis shift of tone-generation points, the melody pitch data modifying unit 33*d* modifies melody pitch data according to the command. Since this modification is individually performed with respect to normal measures and pickup measures in the present embodiment, the musical rule database 35 consists of two types of databases for the normal measures and pickup measures, respectively.

In the manner as described above, the rhythm pattern data modifying unit 33*a* modifies rhythm pattern data, and the skeleton data modifying unit 33*c* modifies each skeleton data, i.e., overall skeleton data, passage skeleton data, and phrase skeleton data, while the melody pitch data modifying unit 33*d* modifies melody pitch data of normal measures and melody pitch data of pickup measures, independently of each other. As these modifying operations proceed, the results of the operations (the progress of composition) are displayed on the display device 9.

In addition to the function of reproducing and playing melody pitch data (musical tone data) generated as a result of modification by the melody pitch data modifying unit 33*d*, the automatic composition apparatus of the present embodiment has a function of reproducing and playing musical tone data of each of the three layers of skeleton data generated as a result of modification by the skeleton data modifying unit 33*c*. If the user designates a certain layer of skeleton data and enters a command for performance of this layer of skeleton data, therefore, pitch data (musical tone data) corresponding to the designated skeleton is read out from the skeleton data that has been modified by the skeleton data modifying unit 33*c*, reproduced, and then converted into sound by the sound system 17. If the user enters a command for melody performance, on the other hand, pitch data (musical data) corresponding to the desired melody is read out from the melody pitch data that has been modified as described above, reproduced, and then converted into sound by the sound system 17.

The present invention is characterized by the rhythm pattern data modifying operation, among the above-described three types of main operations, i.e., rhythm pattern data modifying operation, skeleton data modifying operation and melody pitch data modifying operation, which are performed by the melody template modifying unit 33. In the present embodiment, the rhythm pattern modifying operation encompasses two types of processes, namely, rhythm pattern data modifying process 1 and rhythm pattern data modifying process 2.

Figure 4:
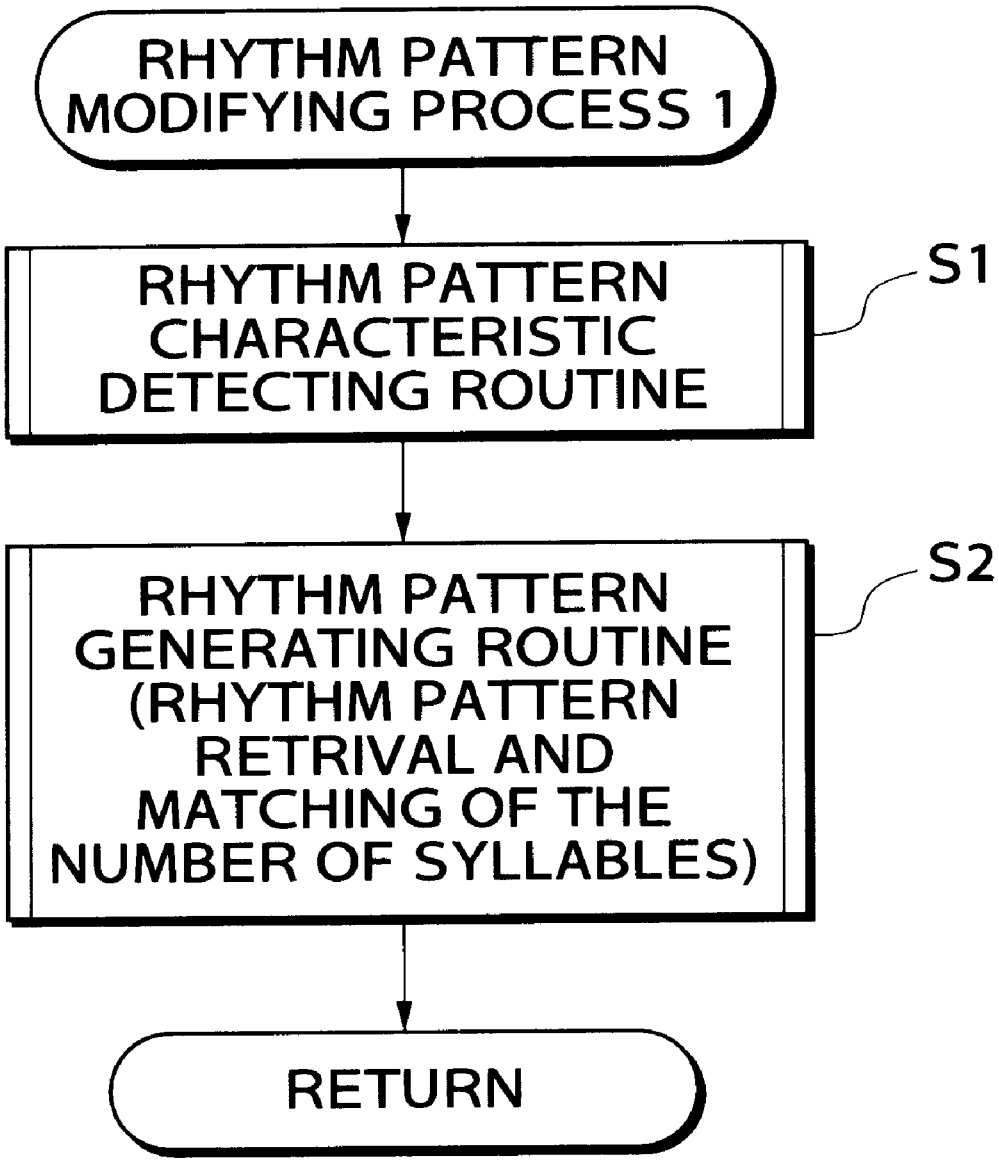
FIG. 4 is a flowchart showing the flow of a rhythm pattern modifying process 1 to be implemented by a CPU, in particular, of the automatic composition apparatus of FIG. 1.
Figure 5:
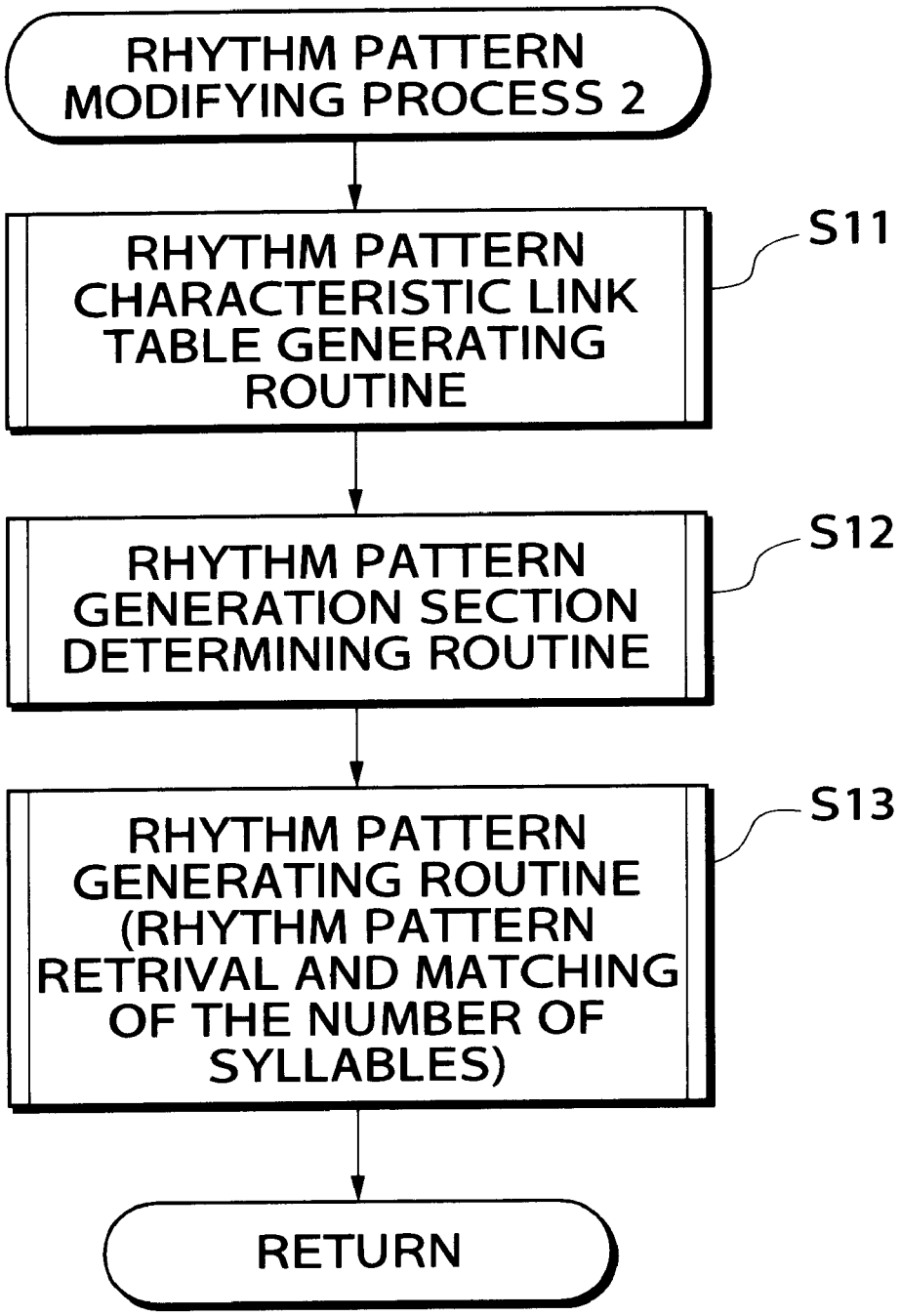
FIG. 5 is a flowchart showing the flow of a rhythm pattern modifying process 2 to be implemented by a CPU, in particular, of the automatic composition apparatus of FIG. 1.

Referring to FIGS. 4 and 5, the summary of the rhythm pattern data modifying process 1 and rhythm pattern data modifying process 2 will be initially described. Subsequently, the rhythm pattern data modifying process 1 will be described in detail referring to FIG. 6 through FIG. 14, and the rhythm pattern data modifying process 2 will be described in detail referring to FIG. 15 through FIG. 25.

1) Rhythm pattern data modifying process 1 (FIG. 4): This process is performed so as to slightly modify a rhythm pattern of a melody template without changing composition conditions, and principally consists of the following three steps a), b) and c).
   a) Step of detecting characteristics of a known or existing rhythm pattern (a rhythm pattern of a melody template) (step S1)
   b) Step of retrieving a rhythm pattern having the same characteristics as those detected in the above step a), from the rhythm pattern data base 34
   c) Step of matching the number of syllables In FIG. 4, the above-described steps b) and c) are combined and represented as "rhythm pattern generating operation (step S2)".

2) Rhythm pattern data modifying process 2 (FIG. 5): This process is performed so as to newly set or establish composition conditions and significantly modifies a rhythm pattern in a melody template, and principally consists of the following three steps d), e), b') and c).
   d) Step of generating a rhythm pattern characteristic link table (step S11)
   e) Step of determining pattern occupied sections of measures (for each of which a rhythm pattern is generated) (step S12)
   b') Step of retrieving a rhythm pattern with characteristics that match the set composition conditions, from the rhythm pattern database 34
   c) Step of matching the number of syllables In FIG. 5, the above-described steps b') and c) are combined and represented as "rhythm pattern generating operation (step S13)".

Here, the above operation a) is performed for the purpose of increasing variations in the rhythm of melodies to be generated, for example, or increasing the number of sets of data (templates) stored in the melody template database 32. In the present embodiment, when the number of tone-generation points is increased or reduced, a certain rhythm pattern in a currently selected melody template is replaced by another rhythm pattern having the same characteristics as the rhythm pattern in the melody template but having a different number of tone-generation points, as described later. To replace the existing rhythm pattern by a different rhythm pattern having the same tone-generation points, the rhythm pattern is replaced by another rhythm pattern having the same characteristics as those in the melody temperate and also having the same tone-generation points. In another case, the existing rhythm pattern in the melody template may be desired to be replaced by a rhythm pattern having different characteristics from that in the melody template. In such cases, the existing rhythm pattern may be easily replaced by another rhythm pattern having the same characteristics or different characteristics, by detecting or extracting characteristics of the existing rhythm pattern in the melody template, to thereby increase variations of melodies that can be generated. Also, there is no need to manually detect characteristics of rhythm patterns in a melody template when registering the melody template (rhythm pattern) in the melody template database 32. It is therefore possible for one having no musical knowledge enough to analyze characteristics of rhythm patterns to register desired melody data in the database, thus assuring a wide variety of data stored in the melody template database 32.

By retrieving a rhythm pattern having the same characteristics as that detected in the above step a) from the rhythm pattern data base 34 in step b), the rhythm pattern may be modified into another rhythm pattern having the same characteristics as the original pattern.

The operations c) and d) have been briefly explained above referring to FIG. 3, and therefore will not be explained herein.

The operation e) is performed so as to deal with the case where a single rhythm pattern cannot be allocated to the entire range of one measure (for example, when the measure in question is a pickup measure). In this case, the measure is divided into a plurality of pattern occupied sections that are associated with either one of adjacent measures that precedes or follows the measure in question. Where the measure in question is a pickup measure, for example, a part (the former half) of this measure belongs to the last phrase and is associated with the measure immediately before the current measure in question, and therefore a single rhythm pattern cannot be allocated to the entire range of the measure. In this case, therefore, the measure is divided into a first pattern occupied section that is associated with the immediately preceding or last measure of the last phrase, and a second pattern occupied section (pickup section) that is associated with the current measure of the current phrase, as described later referring to FIG. 25. Also, where the measure in question is the last measure of the current phrase, and the next phrase starts with a pickup measure, this measure is divided into a first pattern occupied section associated with the last measure of the current phrase, and a second pattern occupied section (pickup section) associated with the next measure (pickup measure) of the next phrase. Where the measure in question is a normal measure, on the other hand, a single rhythm pattern can be placed over the entire range of this measure, and therefore no dividing of the measure is needed.

The operation b') is substantially the same as the above-described operation b), but is different therefrom in that a rhythm pattern having characteristics that match the composition conditions set by the user, rather than a rhythm pattern having the same characteristics as detected in the existing rhythm pattern, is retrieved from the rhythm pattern database 34.

FIG. 6 shows, for illustrative purpose only, a set of rhythm pattern data that constitutes the rhythm pattern database 34.

The rhythm pattern database 34 consists of, for example, six types of rhythm pattern data each of which is independently constructed with respect to each of the times as indicated in FIG. 2, namely, two-four time, three-four time, four—four time, six-eight time, three-part three-four time, and three-part four—four time. For example, the following number of four—four time rhythm patterns are present (where the shortest note is an eighth note):

1) Number of rhythm pattern with 0 syllable=8C0=1
2) Number of rhythm pattern with 1 syllable=8C1=8
3) Number of rhythm pattern with 2 syllables=8C2=28
4) Number of rhythm pattern with 3 syllables=8C3=56
5) Number of rhythm pattern with 4 syllables=8C4=70
6) Number of rhythm pattern with 5 syllables=8C5=56
7) Number of rhythm pattern with 6 syllables=8C6=28
8) Number of rhythm pattern with 7 syllables=8C7=8

Thus, the total number of rhythm patterns of four—four meter is 256.

FIG. 6 illustrates the four-syllable rhythm patterns of 5) as indicated above, among the rhythm patterns of four—four time. As shown in FIG. 6, various rhythm pattern characteristics, such as "length of the initial tone", "syncopation", "dotted note (bounce)", "sense of ending" and "complexness", for which matching with the above composition conditions is to be judged, are given to each rhythm pattern. If a rhythm pattern characteristic link table is generated, and the composition conditions are set for each measure as described above, therefore, the set composition conditions are compared with the rhythm pattern characteristics stored in the rhythm pattern database 34, so that some candidates of rhythm patterns that match the set composition conditions are immediately retrieved from the rhythm pattern database 34.

In the present embodiment, it is also possible to generate rhythm patterns in which the shortest note is a sixteenth note. More specifically, the time axis of rhythm pattern data in which the shortest note is eighth note is compressed or shortened to one half, and one measure is divided into the former half and the latter half, to which each compressed rhythm pattern is applied, so that the shortest note of the resulting pattern is sixteenth note. As shown in FIG. 6, each rhythm pattern is also represented using sixteenth notes as the basic or shortest note. Some items of the composition conditions may have different values or levels depending upon whether the shortest note is eighth note or sixteenth note. For example, when the number of the rhythm pattern is "2", the level of complexness is "1" where the shortest note is eighth note, while the same level is "3" where the shortest note is sixteenth note. In FIG. 6, "8" and "16" are noted at the top of the columns of such items, so as to indicate the case where the shortest note is eighth note and the case where it is sixteenth note, respectively.

In the above manner, a group of rhythm patterns corresponding to each time and each number of syllables is generated, and different banks are provided each of which corresponds to each time and each number of syllables. Thus, the rhythm pattern database 34 is constructed by associating each group of rhythm patterns with a corresponding bank. Once the time and the number of syllables are determined, therefore, the corresponding bank is determined, and some candidates of rhythm patterns that match the set composition conditions are selected from the group of rhythm patterns in the corresponding bank. Thus, in the present embodiment, the groups of rhythm patterns are associated with the respective banks, and therefore a desired rhythm pattern can be easily selected from a relatively narrow range of choice, thus simplifying an algorithm for retrieving the desired rhythm pattern.

The rhythm pattern characteristic detecting operation of step S1 above will be now briefly explained, and then described in detail with reference to the flowchart of FIG. 7.

As described above, in the rhythm pattern database 34, the rhythm patterns are stored in association with characteristic data that characterize the respective rhythm patterns. In the present rhythm pattern characteristic detecting operation, a rhythm pattern whose characteristics are to be detected, namely, an existing rhythm pattern (for example rhythm= tone-generation point pattern in a certain melody template) is sequentially compared with each of the rhythm patterns of the group having the same tone-generation points that are stored in the rhythm pattern database 34. When the rhythm patterns thus compared coincide with each other, characteristic data affixed to the matching rhythm pattern are read out from the rhythm pattern data 34, to be defined as characteristic data of the rhythm pattern whose characteristics are to be detected. Thus, the characteristics of the desired rhythm pattern can be easily detected simply by comparing the existing rhythm pattern with the rhythm patterns of the corresponding group in the database 34.

Figure 7:
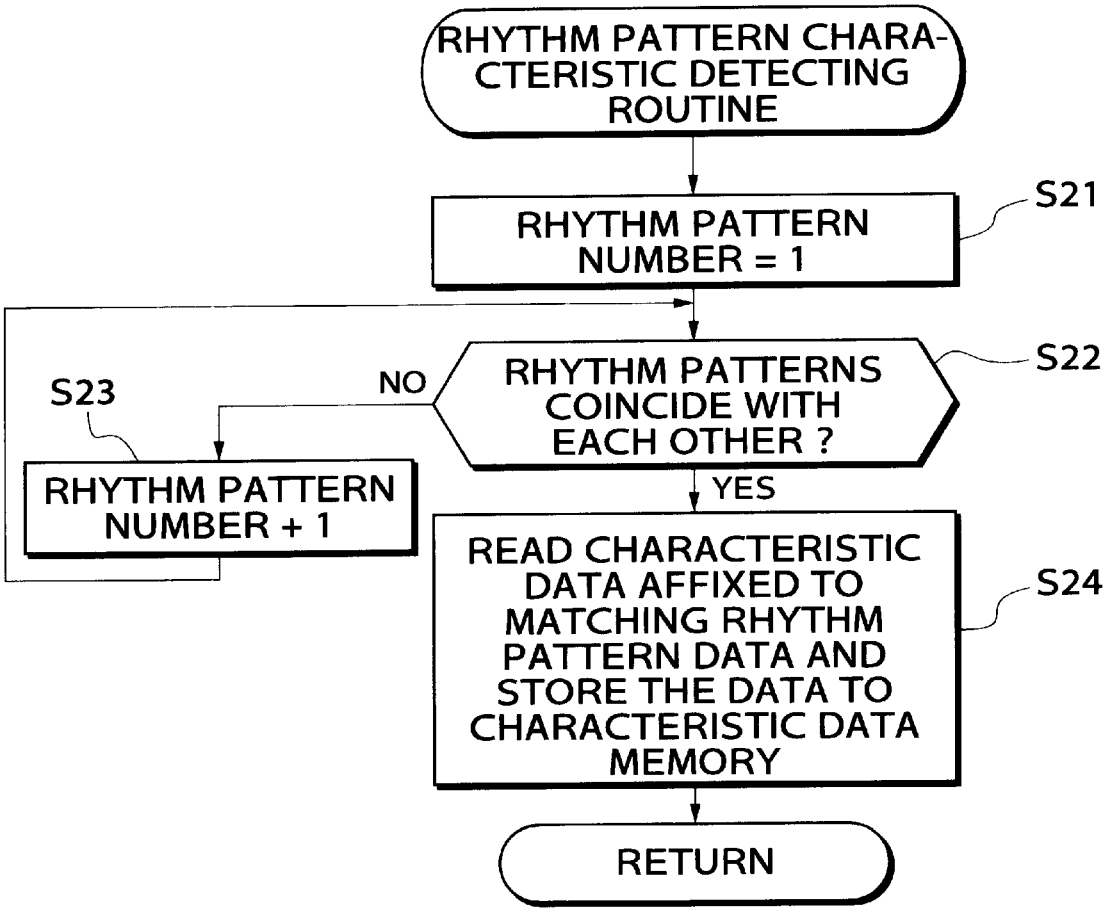
FIG. 7 is a flowchart showing in detail the flow of a rhythm pattern characteristic detecting routine of FIG. 4.

FIG. 7 is a flowchart showing in detail the flow of the rhythm pattern characteristic detecting routine.

In the routine of FIG. 7, step S21 is first executed to initialize a rhythm pattern number counter to "1". The rhythm pattern number counter is in the form of a soft counter provided in a certain region of the RAM 7 for counting the rhythm pattern number.

Step S22 is then executed to determine whether the rhythm pattern whose characteristics are to be detected coincides with the rhythm pattern in the rhythm pattern database 34 which is designated by the rhythm pattern number counter and belongs to a group having the same number of tone-generation points as that of the rhythm pattern whose characteristics are to be detected. If a negative decision (NO) is obtained in step S22, step S23 is executed to increment the rhythm pattern number counter by "1", so that the counter points to the next rhythm pattern of the same group, and the control flow returns to step S22. If an affirmative decision (YES) is obtained in step S22, the control flow goes to step S24 in which the rhythm pattern characteristic data affixed to the matching rhythm pattern is read from the rhythm pattern database 34, and stored to a characteristic data memory (provided in a certain region of the RAM, for example) that corresponds to the rhythm pattern whose characteristics are to be detected. After execution of step S24, the present rhythm pattern characteristic detecting routine is finished.

Where the shortest note of the rhythm pattern whose characteristics are to be detected is eighth note, characteristic data for the case where the shortest note is eighth note, among characteristic data corresponding to each rhythm pattern in the rhythm pattern database, is read out from the rhythm pattern database. Similarly, where the shortest note of the rhythm pattern whose characteristics are to be detected is sixteenth note, characteristic data for the case where the shortest note is sixteenth note is read out from the rhythm pattern database.

In the above manner, the characteristic data of the desired rhythm pattern is detected merely by detecting coincidence with any one of the rhythm patterns in the rhythm pattern database 34, thus eliminating a need to detect characteristics using a complicated characteristic detecting algorithm. This leads to a reduction in the time required for developing a program for detecting characteristics, and a reduction in the program capacity, which eventually results in a reduced cost of the apparatus.

Figure 8:
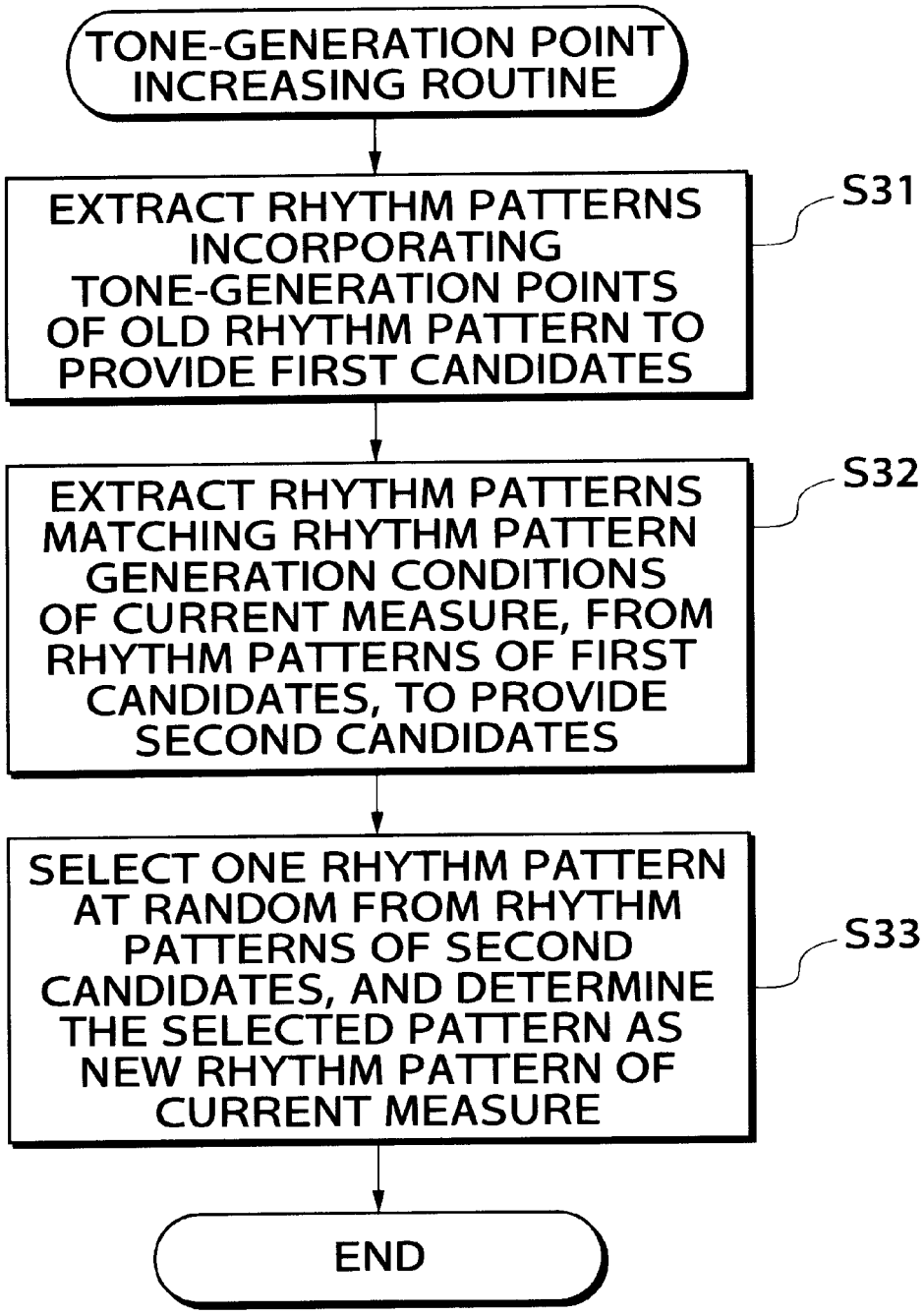
FIG. 8 is a flowchart showing in detail the flow of a tone-generation point increasing routine.
Figure 10:
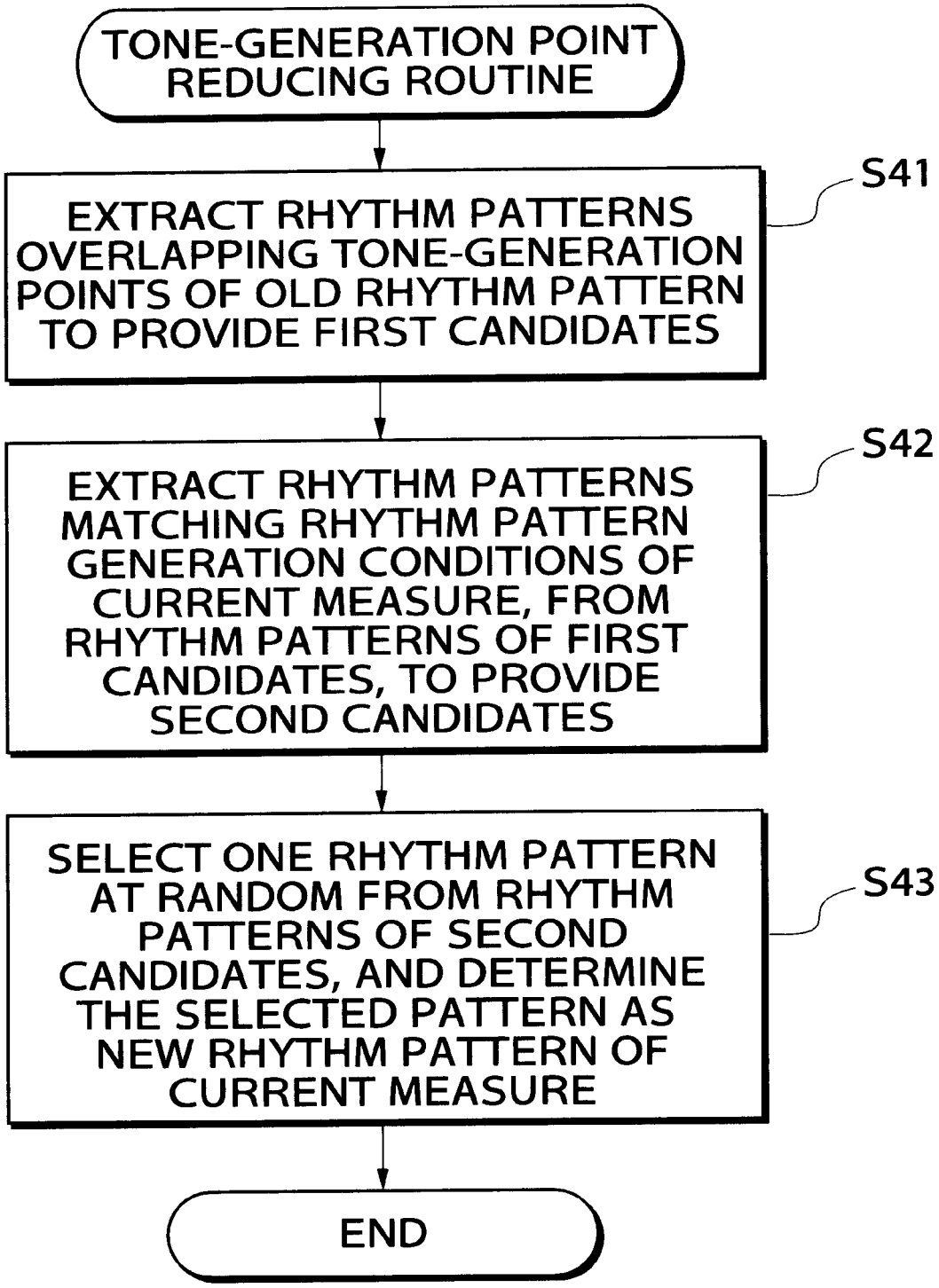
FIG. 10 is a flowchart showing in detail the flow of a tone-generation point reducing routine.

Next, the operation of matching the number of syllables, which is included in the rhythm pattern generating operation of the above step S2, will be now briefly explained, and then described in detail referring to the flowcharts of FIG. 8 and FIG. 10.

In the present embodiment, matching of the number of syllables is carried out in the cases 1) where the number of syllables set by the user is different from the number of syllables in the melody template selected by the user, and 2) where the user increases or reduces the number of syllables in the course of composition.

The matching of the number of syllables is performed in the following manner:

1) In the case where a new tone-generation point or points is/are created in a measure in which the original or old number of tone-generation points is "0",
   a) priority 1: if the passage in question is the same-name or similar passage, and the number of syllables of the same-number measure (reference measure) of the same-number phrase of its reference passage is equal to the new number of syllables, the rhythm pattern of the measure in question is made identical with that of the reference measure, or
   b) priority 2: a new rhythm pattern is generated according to the set conditions.
2) In the case where the number of tone-generating points is increased,
   a) priority 1: if the passage in question is the same-name or similar passage, and the number of syllables of the same-number measure (reference measure) of the same-number phrase of its reference passage is equal to the new number of syllables, the rhythm pattern of the measure in question is made identical with that of the reference measure, or
   b) priority 2: a new rhythm pattern that incorporates or comprehends the old rhythm pattern (the meaning of "incorporate" will be described later referring to FIG. 9) is generated according to the set conditions.
3) In the case where the number of tone-generation point is reduced, and at least one tone-generation point remains,
   a) priority 1: if the passage in question is the same-name or similar passage, and the number of syllables of the same-number measure (reference measure) of the same-number phrase of its reference passage is equal to the new number of syllables, the rhythm pattern of the measure in question is made identical with that of the reference measure, or
   b) priority 2: a new rhythm pattern that overlaps the old rhythm pattern (the meaning of "overlap" will be described later referring to FIG. 11) is generated according to the set conditions.
4) In the case where the number of tone-generation points becomes equal to "0", all tone-generation points are eliminated.

FIG. 8 is a flowchart showing details of the flow of a tone-generation point increasing routine, which implements the above method 2) b) of matching the number of syllables.

In FIG. 8, step S31 is initially executed to extract, from a table, rhythm patterns each of which incorporates the old rhythm pattern and whose number of syllables is equal to the new number of syllables, to provide first candidates.

Step S32 is then executed to extract such rhythm patterns that match the rhythm pattern generation conditions of the measure in question (i.e., rhythm patterns having the same characteristic data as the old rhythm pattern), from the rhythm patterns of the first candidates, to provide second candidates. Where no rhythm pattern matches the set rhythm pattern generation conditions, the conditions are relaxed or eased step by step as needed.

After one rhythm pattern is selected at random from the rhythm patterns of the second candidates, to be determined as a new rhythm pattern of the measure in question in step S33, the present tone-generation point increasing routine is finished.

FIG. 9 shows, for illustrative purpose only, a set of rhythm patterns from which a new rhythm pattern of a certain measure may be selected when the number of tone-generation points is increased. In FIG. 9 are illustrated various types of new rhythm patterns that are determined according to data values of characteristic data set by the user or characteristic data detected in the rhythm pattern characteristic detecting operation as described above. Each of the new rhythm patterns incorporates or comprehends the old rhythm pattern. Here, "incorporating" the old rhythm pattern means that the new rhythm pattern thus generated always retains the tone-generation points contained in the old rhythm pattern. As indicated by dotted lines in FIG. 9, each of the new rhythm patterns includes tone-generation points that are generated at the positions corresponding to the tone-generation points of the old rhythm pattern.

FIG. 10 is a flowchart showing details of the flow of a tone-generation point reducing routine, which implements the above method 3) b) of matching the number of syllables.

In FIG. 10, step S41 is initially executed to extract, from a table, rhythm patterns each of which overlaps the tone-generation points of the old rhythm pattern and whose number of syllables is equal to the new number of syllables, to provide first candidates.

Step S42 is then executed to extract such rhythm patterns that match the rhythm pattern generation conditions of the measure in question (rhythm patterns having the same characteristic data as the old rhythm pattern), from the rhythm patterns of the first candidates, so as to provide second candidates. Where no rhythm pattern matches the set rhythm pattern generation conditions, the conditions are relaxed or eased step by step as needed.

After one rhythm pattern is selected at random from the rhythm patterns of the second candidates, to be determined as a new rhythm pattern of the measure in question in step S43, the present tone-generation point increasing routine is finished.

FIG. 11 shows, for illustrative purpose only, a set of rhythm patterns from which a new rhythm pattern of a certain measure may be selected when the number of tone-generation points is reduced. In FIG. 11 are illustrated various types of new rhythm patterns that are determined according to data values of characteristic data set by the user or characteristic data detected in the rhythm pattern characteristic detecting operation as described above. Each of the new rhythm patterns overlaps the old rhythm pattern. Here, "overlapping" the old rhythm pattern means that the new rhythm pattern is generated only by reducing one or more tone-generation point(s) contained in the old rhythm pattern, without generating any new tone-generation point, as shown in FIG. 11.

Figure 12:
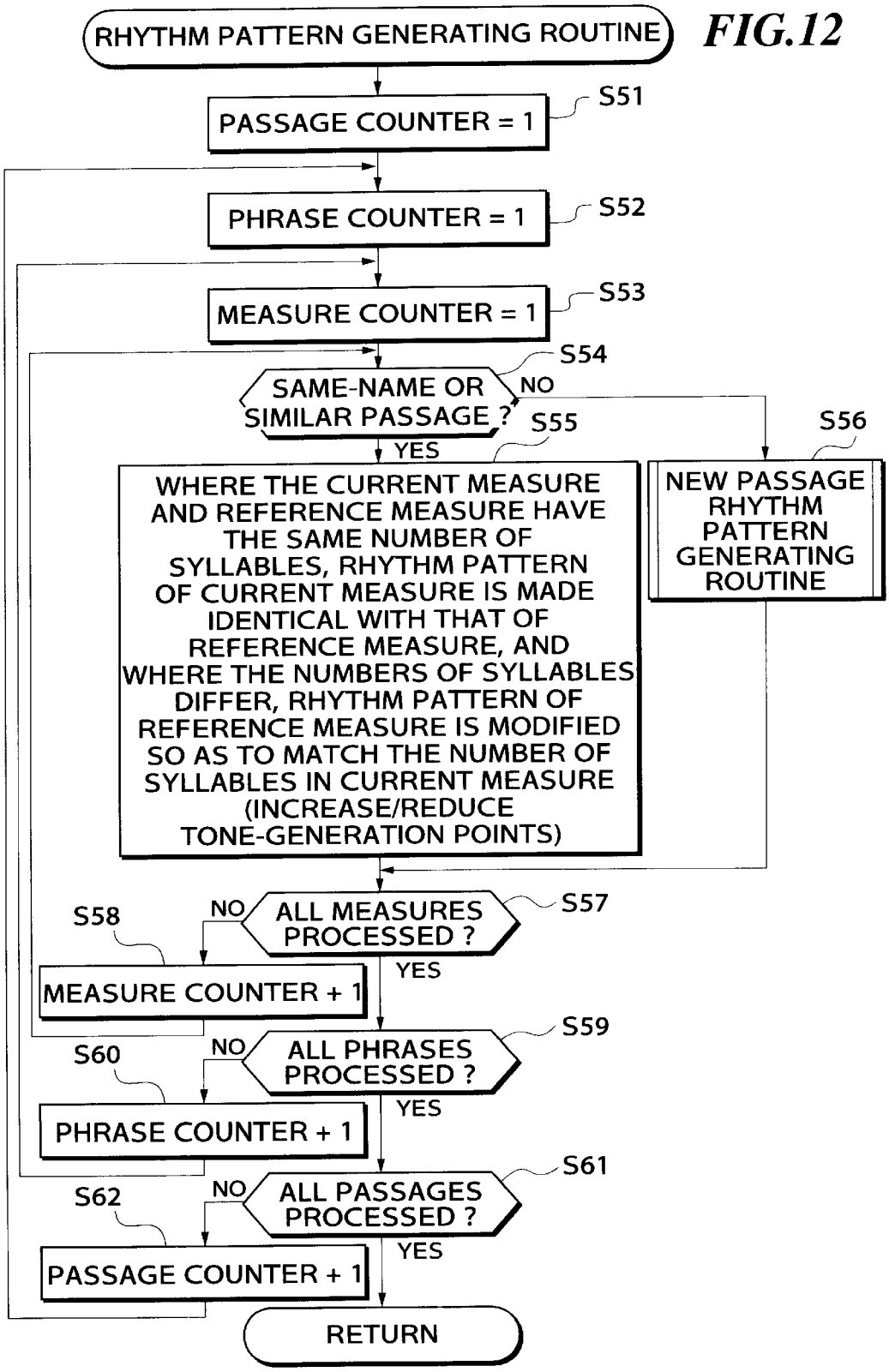
FIG. 12 is a flowchart showing in detail the flow of a rhythm pattern generating routine of FIG. 4.

FIG. 12 is a flowchart showing details of the flow of a rhythm pattern generating routine (the above step S2) for generating a rhythm pattern for the whole piece of music.

In FIG. 12, step S51 is first executed to initialize a passage counter to "1". The passage counter is in the form of a soft counter provided in a certain region of the RAM 7 for counting passages in the piece of music.

Step S52 is then executed to initialize a phrase counter to "1". The phrase counter is a soft counter provided in a certain region of the RAM 7 for counting phrases in the current passage.

Step S53 is then executed to initialize a measure counter to "1". The measure counter is a soft counter provided in a certain region of the RAM 7 for counting measures in the current phrase.

Step S54 is then executed to determine whether the passage in question is the same-name or similar passage or not. If the current passage is the same-name or similar passage, and the number of syllables of the measures in question is equal to that of the reference measure, the rhythm pattern of this measure is made identical with that of the reference measure in step S55. If the number of syllables of the measure in question is different from that of the reference measure, the rhythm pattern of the reference measure is modified by increasing or decreasing the number of tone-generation points to be matched with the number of syllables of the measure in question, to thus provide a rhythm pattern for the measure in question in step S55. After execution of step S55, the control flow goes to step S57. If the passage in question is not the same-name or similar passage, a subroutine for generating a rhythm pattern of a new passage (which will be described later using FIG. 13) is executed, and then the control flow goes to step S57. Matching of the number of syllables in step S55 is achieved by performing the syllable number matching operation as described above.

In step S57, it is determined whether the operations of the above steps S54–S56 have been finished with respect to all of the measures in the current phrase. If any of the measures still remains unprocessed, step S58 is executed to increment the measure counter by "1", and the control flow returns to step S54. If all of the measures in the current phrase have been processed, the control flow goes to step S59.

In step S59, it is determined whether the operations of the above steps S53–S58 have been finished with respect to all of the phrases in the current passage. If any of the phrases still remains unprocessed, step S60 is executed to increment the phrase counter by "1", and the control flow returns to step S53. If all of the phrases in the current passage have been processed, the control flow goes to step S61.

In step S61, it is determined whether the operations of the above steps S52–S60 have been finished with respect to all of the passages in the piece of music. If any of the passages remains unprocessed, step S62 is executed to increment the passage counter by "1", and the control flow returns to step S52. If all of the passages have been finished, the present rhythm pattern generating routine is finished.

Figure 13:
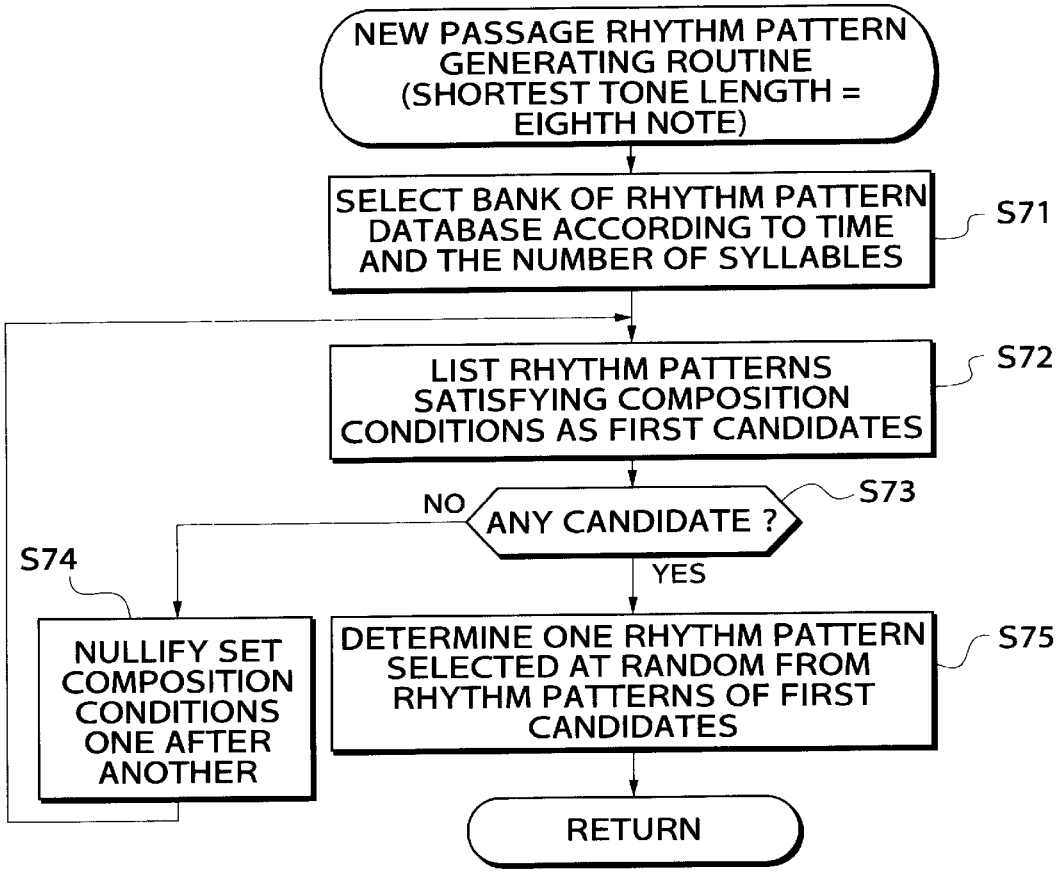
FIG. 13 is a flowchart showing in detail the flow of a new passage rhythm pattern generating subroutine of FIG. 12.

FIG. 13 is a flowchart showing in detail the flow of the subroutine of step S56 for generating a rhythm pattern of a new passage. In the rhythm pattern generating subroutine, a rhythm pattern in which the shortest tone length is that of an eighth note is allocated to a pattern occupied section of a certain measure.

In FIG. 13, step S71 is initially executed to select one of the banks of the rhythm pattern database 34 according to the time or meter and the number of syllables that have been set. In the present embodiment, one bank (storing a group of rhythm patterns) is associated with each combination of the time and the number of syllables, as described above. Thus, one group of rhythm patterns is roughly selected by determining the bank, and then candidates of rhythm patterns that match other composition conditions are selected from the selected group of rhythm patterns.

Step S72 is executed to select the rhythm patterns that satisfy the composition conditions and have the tone-generation points located only within the pattern occupied section, as first candidates. Step S73 is then executed to determine whether any first candidate of rhythm pattern that has been selected exists or not. If the measure is divided into two sections, i.e., the former half and the latter half, rhythm patterns are individually generated for the respective sections.

If step S73 determines that no first candidate of rhythm pattern exists, step S74 is executed to relax or ease the conditions by sequentially nullifying the set composition conditions, and the control flow returns to step S72 to select or list the first candidates again. If the first candidates of rhythm patterns exist, step S75 is executed to select one rhythm pattern at random from the first candidates of rhythm patterns, and the present new passage rhythm pattern generating operation is finished.

Figure 14:
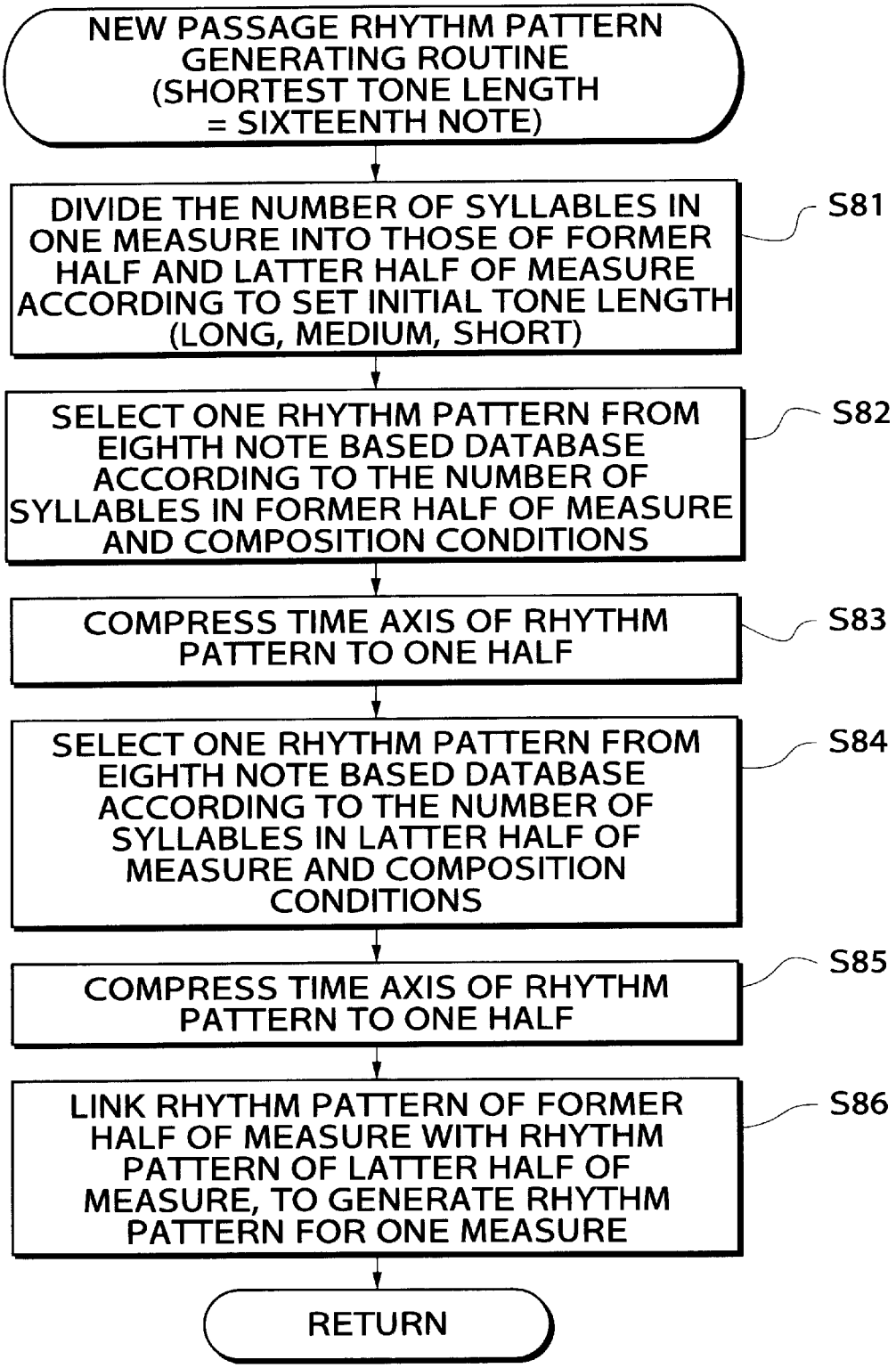
FIG. 14 is a flowchart showing in detail the flow of another new passage rhythm pattern generating subroutine.

FIG. 14 is a flowchart showing in detail the flow of another subroutine for generating a rhythm pattern of a new passage. The present new passage rhythm pattern generating routine is different from that of FIG. 13 in that a rhythm pattern in which the shortest tone length is that of a sixteenth note is allocated to each pattern occupied section.

In FIG. 14, step S81 is executed to divide one measure for which the number of syllables has been set, into the former half and the latter half, according to the length (long or medium or short) of the initial tone indicative of the set number of syllables in one measure. Where the length of the initial tone is "long", for example, the number of notes in the former half of the measure is reduced, and the number of notes in the latter half is increased so that the ratio becomes equal to 3:7. Where the length of the initial tone is "medium", the number of notes in each of the former half and the latter half is made substantially equal to each other (the ratio is equal to 5:5).

Step S82 is then executed to select one rhythm pattern from eighth-note based rhythm patterns contained in the rhythm pattern database 34, according to the number of syllables in the former half of the measure, composition conditions, and the pattern occupied section, and step S83 is then executed to compress the time axis of the rhythm pattern to a half. Needless to say, the composition conditions for rhythm patterns on the basis of sixteenth notes (in the columns denoted by 16) are referred to in step S82, as explained above referring to FIG. 6.

Similarly, step S84 is executed to select one rhythm pattern from the eighth-note based rhythm patterns contained in the rhythm pattern database 34, according to the number of syllables in the latter half of the measure, composition conditions, and the pattern occupied section, and step S85 is then executed to compress the time axis of the rhythm pattern to a half.

Step S86 is then executed by linking the rhythm pattern generated in step S83 for the former half of the measure with the rhythm pattern generated in step S84 for the latter half of the measure, to thereby generate a rhythm pattern for the full measure, and the present new passage rhythm pattern generating routine is finished. In the case where the shortest tone length is that of a sixteenth note, too, rhythm patterns are individually generated for the former half and the latter half of the divided measure.

In the manner as described above, the rhythm pattern generation sections or pattern occupied sections are first determined, and rhythm patterns are allocated to the respective sections thus determined. Accordingly, even where one rhythm pattern cannot be allocated to the entire or full measure, as in the case where the measure in question is a pickup measure, rhythm patterns suited for this measure can be appropriately allocated to the respective sections of the measure, thus increasing a variety of pieces of music for which the rhythm pattern data can be generated.

Figure 15:
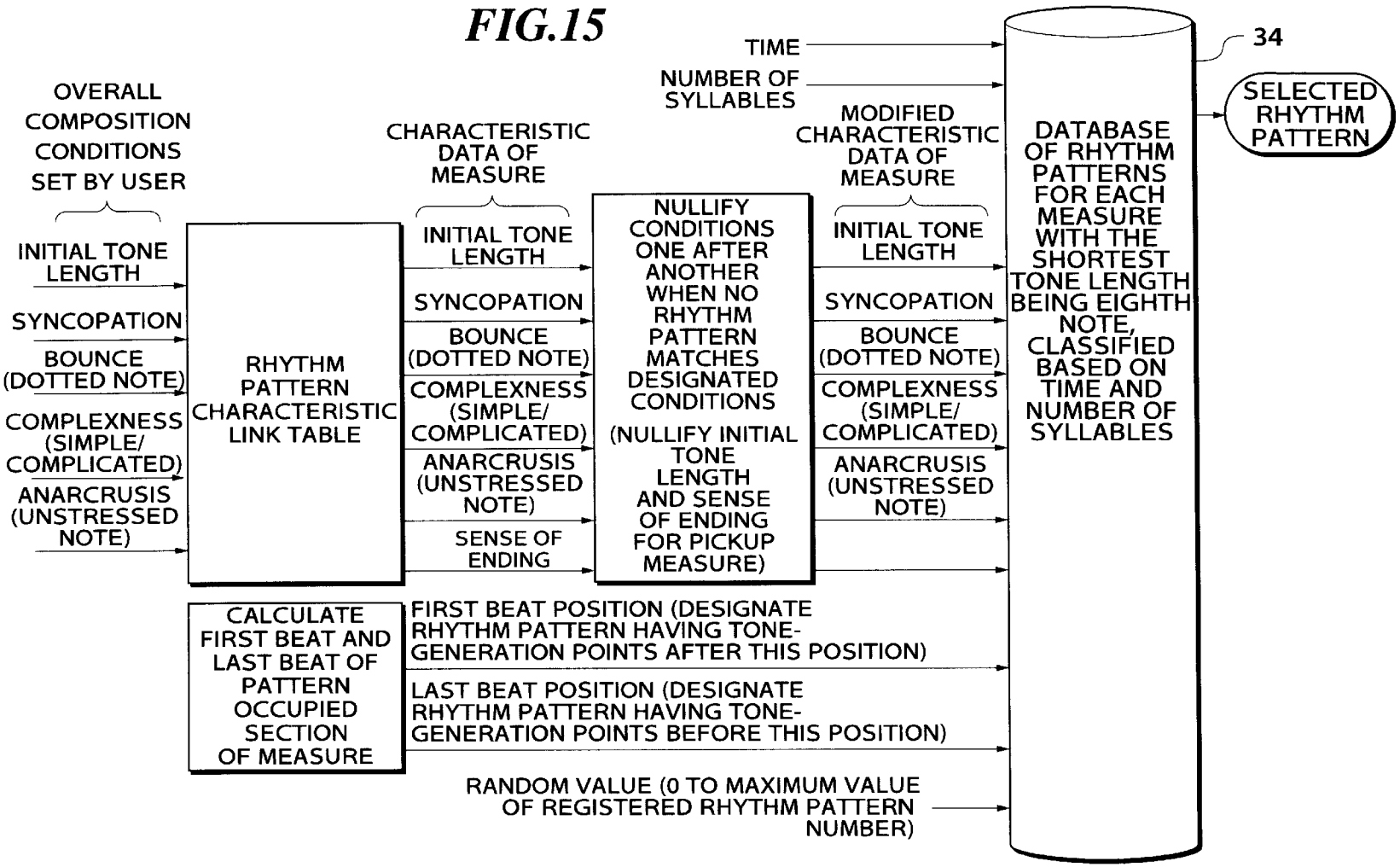
FIG. 15 is a view visually showing the rhythm pattern modifying process 2 of FIG. 5.

FIG. 15 is a view visually representing the rhythm pattern data modifying process 2 of FIG. 5.

In FIG. 15, if the user sets conditions (including such items as the presence of anacrusis (unstressed note), the presence of syncopation, the presence of a bounce (dotted note), the length of the initial tone, and the level of complexness in the present embodiment) used for modifying the rhythm pattern data, among the overall composition conditions, a rhythm pattern data characteristic link table for each measure is generated based on the set conditions. In the present embodiment, each of the above conditions is set as follows:

1) The length of the initial tone is set to a selected one of "long", "medium" and "short".
2) The syncopation and bounce are set to certain levels (an integer selected from 0 to 3).
3) The sense of ending and the presence of anacrusis (unstressed note) are both set to one of ON and OFF.
4) The complexness is set to a certain level (an integer selected from 0 to 3).

The above-indicated rhythm pattern data modifying unit 33*a* generates the rhythm pattern characteristic link table, based on the composition conditions thus established.

FIG. 16A shows the relationship between the set levels and the passage, phrase and measure to which the composition conditions may be applied, and FIG. 16B shows one example of rhythm pattern characteristic link table generated by the rhythm pattern data modifying unit 33*a*.

The relationship as indicated in FIG. 16A is applied to the syncopation and bounce, among those (syncopation, bounce and complexness) for which the set levels may be established. With regard to the presence of a bounce as one of composition conditions, for example, the relationship between the set level and each of the passage, phrase and measure that may be played with a bounce or bounces is determined as follows:

1) Set level=0: All passages, all phrases and all measures are played without any bounce.
2) Set level=1
   a) Passage: Whether a bounce is included (ON) or not (OFF) is determined at random with respect to a new passage, and the ON/OFF (presence/absence) of bounce in a same-name or similar passage is determined to be the same as that of its reference passage (the same-name or similar passage that precedes the passage in question). It is to be noted that the number of passages including bounces is 50% or more of the total number of passages.
   b) Phrase: Whether a bounce is included (ON) or not (OFF) is determined at random with respect to phrases in a new passage, and the ON/OFF (presence/absence) of bounce in each phrase of a same-name or similar passage is determined to be the same as that in a corresponding phrase of its reference passage. It is to be noted that the number of phrases including bounces is 50% or more of the total number of phrases in the passage in question.
   c) Measure: Whether a bounce is included (ON) or not (OFF) is determined at random with respect to measures in a new passage, and the ON/OFF (presence/absence) of bounce in each measure of a same-name or similar passage is determined to be the same as that in a corresponding measure in its reference passage. It is to be noted that the number of measures including bounces is 50% or more of the total number of measures in the phrase in question that may include bounces. A measure may not include a bounce, in other words, may not played with a bounce, where the number of syllables in this measure is "0" or "1".
3) Set level=3: All passages, all phrases and all measures are played with a bounce(s).

With regard to syncopation, the same relationship as described above may be applied to the relationship between the set level and the passage, phrase, and measure in which syncopation may be used, by replacing "bounce" by "syncopation". It is also possible to employ different relationships with respect to bounce and syncopation, respectively.

The relationship between each set value of the other conditions, i.e., the length of the initial tone, sense of ending, complexness and anacrusis (unstressed note), and its reflection (allocation) onto the rhythm pattern characteristic link table is determined as follows:

1) The length of the initial tone is randomly allocated to each measure so that the initial tone length that has been set or established appears at the highest frequency. (The initial tone length in each measure of a same-name or similar passage is made equal to that in a corresponding measure of its reference passage.)
2) The sense of ending is set to "ON" only with respect to the last measure of each phrase when the setting for the piece of music is "ON".
3) The set level of the complexness is established for each of all measures in the piece of music.

The overall composition conditions set by the user is allocated to each measure of the music piece according to the rules as described above, so as to generate a rhythm pattern characteristic link table as exemplarily shown in FIG. 16B. In FIG. 16B, symbols "A", "A'", "B" and "C" are affixed to the first, second, third and fourth passages, respectively. These symbols are called passage symbols that represent the identity or similarity among passages. For example, the second passage to which "A'" is affixed is a similar passage of the first passage to which "A" is affixed. In the present embodiment, there are two types of similar passages, namely, first type similar passage and second type similar passage, depending upon the degree of similarity, and the degree of similarity of the second type similar passages is set to be lower than that of the first type similar passages. If any passage (not shown in FIG. 16B) subsequent to the first passage with the passage symbol of "A" is given the same passage symbol "A", this passage will be called "same-name passage" (in the example of FIG. 16B, no same-name passage is shown).

Returning to FIG. 15, once the rhythm pattern characteristic link table is generated, the contents for each measure are read out from the table, more specifically, "the length of the initial tone", "syncopation", "bounce", "complexness", "anacrusis" and "sense of ending" established for each measure are read out from the table, and a plurality of candidates of rhythm pattern data that match these conditions and other conditions (such as the time and the number of syllables) are selected or retrieved from the rhythm pattern database 34.

If no candidate of rhythm pattern that matches the designated composition conditions can be found in the rhythm pattern database, the items of the conditions are nullified one after another (the composition conditions are relaxed) until a matching rhythm pattern is found.

If a plurality of rhythm patterns are selected as candidates for one measure, one rhythm pattern is selected at random from these candidates. Then, the rhythm patterns selected for the respective measures are linked together over the whole piece of music, so as to provide a sequence of rhythm patterns for one piece of music.

It is, however, to be noted that the above explanation is only concerned with the method for generating rhythm patterns for the whole piece of music where the music piece consists solely of normal measures. If the piece of music in question includes one or more pickup measure(s), a rhythm pattern of each of the pickup measures is selected by another method. More specifically, the pickup measure is divided into plural pattern occupied sections by determining the range of each section, and the first beat position and last beat position of each section are calculated. Then, the length of the initial tone and the sense of ending among the above composition conditions are nullified, and a rhythm pattern is selected and retrieved from the rhythm pattern database 34 according to the remaining conditions.

The rhythm pattern data modifying process 2 will be now described in detail.

Figure 17:
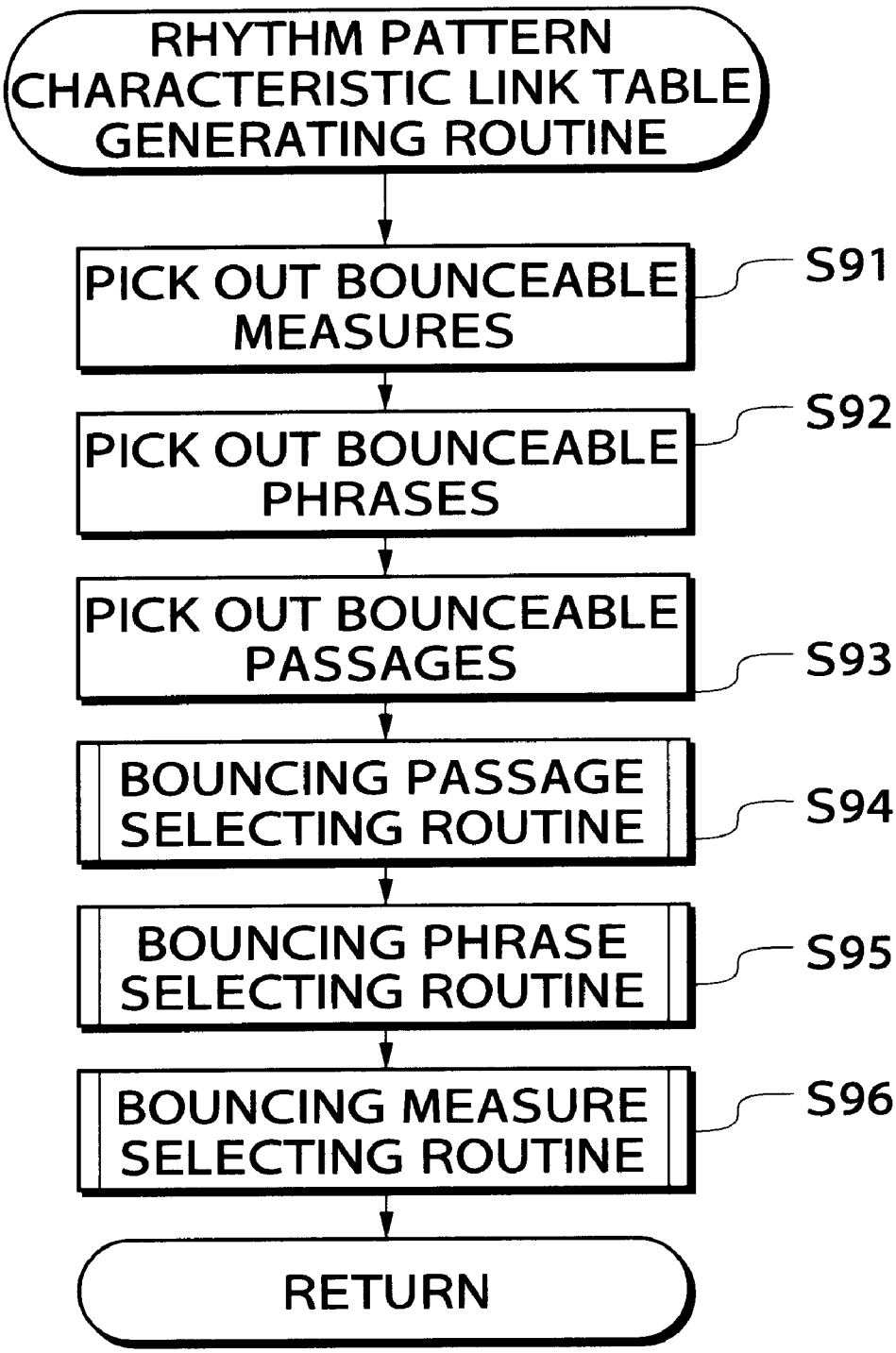
FIG. 17 is a flowchart showing the flow of a rhythm pattern characteristic link table generating routine of FIG. 5.

FIG. 17 is a flowchart showing the flow of the rhythm pattern characteristic link table generating routine of the above-indicated step S11 of FIG. 5. This routine is executed so as to generate data to be entered into the item "bounce" in the rhythm pattern characteristic link table (as shown in FIG. 16A). For other items, for example, "syncopation", the routine of FIG. 17 may be executed with the term "bounce" replaced by "syncopation", to thus easily generate data to be entered into the item "syncopation" in the link table. For the items other than "syncopation", data to be entered into each item may be easily generated according to the rules as described above, without requiring any flowchart, and therefore will not be explained herein.

In FIG. 17, step S91 is initially executed to perform a bounceable measure picking operation (which will be described later) for picking out measures that can be played with a bounce(s). Then, steps S92 and S93 are executed to perform a bounceable phrase picking operation for picking out phrases that can be played with a bounce(s), and a bounceable passage picking operation for picking out passages that can be played with a bounce(s). These operations will be described in detail later.

Subsequently, a subroutine (that will be described later referring to FIG. 18) for selecting passages that actually include a bounce(s) is executed in step S94, and a subroutine (that will be described later referring to FIGS. 19 and 20) for selecting phrases including a bounce(s) is executed in step S95. After a subroutine (that will be described later referring to FIGS. 21 and 22) for selecting measures including a bounce(s) is then executed in step S96, the present rhythm pattern characteristic link table generating routine is finished.

In the bounceable measure picking operation of the above step S91, measures that can be played with a bounce(s) are picked out in the following manner. With respect to all measures from the first measure to the last measure, it is determined whether the number of syllables in each measure is equal to "2" or larger. When the number of syllables is equal to or larger than "2", a bounceable measure flag which is provided for each measure is set to "1" that indicates that the measure in question can be played with a bounce. When the number of syllables is smaller than 2, namely, when the number of syllables is equal to 0 or 1, the bounceable measure flag is reset to "0".

In the bounceable phrase picking operation of the above step S92, phrases that may include bounces are picked out in the following manner. With respect to all phrases from the first phrase to the last phrase, the bounceable measure flags of all of the measures contained in the phrase in question are checked, to determine whether any measure in this phrase may be played with a bounce. When one or more measures in the phrase may include a bounce(s), a bounceable phrase flag which is provided for each phrase is set to "1" that indicates that the phrase in question may include a bounce (s). When no measure in the phrase may include a bounce, the bounceable phrase flag is reset to "0".

In the bounceable passage picking operation of the above step S93, passages that may include a bounce(s) are picked out in the following manner. With respect to all passages from the first passage to the last passage, the bounceable measure flags of all of the measures contained in the passage in question are checked, to determine whether any measure in the passage may include a bounce. When one or more measures in the passage in question may include a bounce (s), a bounceable passage flag which is provided for each passage is set to "1" that indicates that the passage in question may include a bounce(s). When no measure in the passage may include a bounce, the bounceable passage flag is reset to "0".

Figure 18:
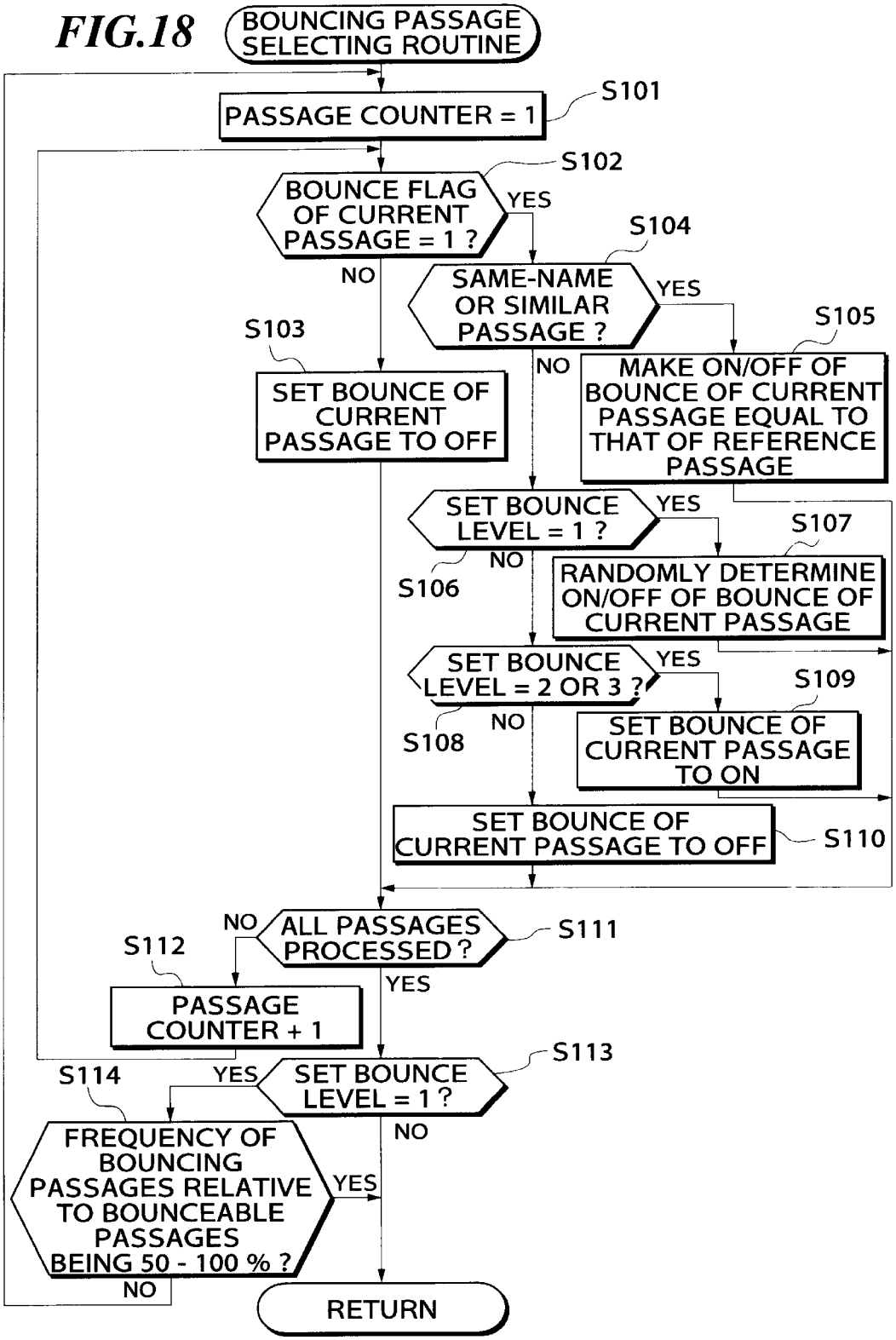
FIG. 18 is a flowchart showing in detail the flow of a bouncing passage selecting subroutine of FIG. 17.

FIG. 18 is a flowchart showing in detail the flow of the bouncing passage selecting subroutine of the above step S94.

In FIG. 18, step S101 is first executed to initialize a passage counter to "1". The passage counter is in the form of a soft counter provided in a certain region of the RAM 7, for counting the passages in a piece of music.

Step S102 is then executed to determine whether the bounceable passage flag of the current passage is "1" or not. When the bounceable passage flag is equal to 0, namely, when the current passage is not a bounceable passage, the bounce of this passage is set to "OFF" in step S103, and the control flow goes to step S111. If the bounceable passage flag is equal to 1, the control flow goes to step S104.

In step S104, it is determined whether the current passage is a same-name/similar passage or not. If it is the same-name/similar passage, the "ON/OFF" of the bounce of the current passage is made equal to that of its reference passage at step S105, and the control flow goes to step S111. If the current passage is not a same-name/similar passage, the control flow goes to step S106.

In step S106 through step S110, passages that actually include bounces (bouncing passages) are determined according to the set bounce level and the rules of FIG. 16A. More specifically, where the set bounce level is equal to 0, the bounce of the current passage is set to "OFF". In this case, the control flow goes from step S106 to step S108, and then to step S110. Where the set bounce level is equal to 1, the "ON/OFF" of the bounce of the current passage is randomly determined (step S106→step S107). If the set bounce level is equal to 2 or 3, the bounce of the current passage is set to "ON" (step S106→step S108→step S109).

In the subsequent step S111, it is determined whether the operations of steps S102→S110 have been finished with respect to all of the passages in the piece of music. If all of the passages have been processed, the control flow goes to step S113. If any of the passages remains unprocessed, step S112 is executed to increment the passage counter by "1", and the above-described operations are repeated.

In step S113, it is determined whether the set bounce level is "1" or not, and, when the set bounce level is equal to 1, it is determined whether the frequency of bouncing passages relative to all bounceable passages is 50% or higher. When the frequency is 50% or higher, the present bouncing passage selecting routine is finished. If the frequency is less than 50%, the control flow returns to step S101, and the above-described operations are repeated until the frequency becomes equal to or higher than 50%.

If step S113 determines that the set bounce level is not equal to 1, the present bouncing passage selecting routine is terminated.

FIG. 23A is a table indicating, for illustrative purpose only, bouncing passages selected in the above manner. In this figure, hatched sections represent bouncing passages. In the example of FIG. 23A, the set level is set to "1", and therefore the frequency of bouncing passages relative to all bounceable passages is selected to be 50% or higher.

Figure 19:
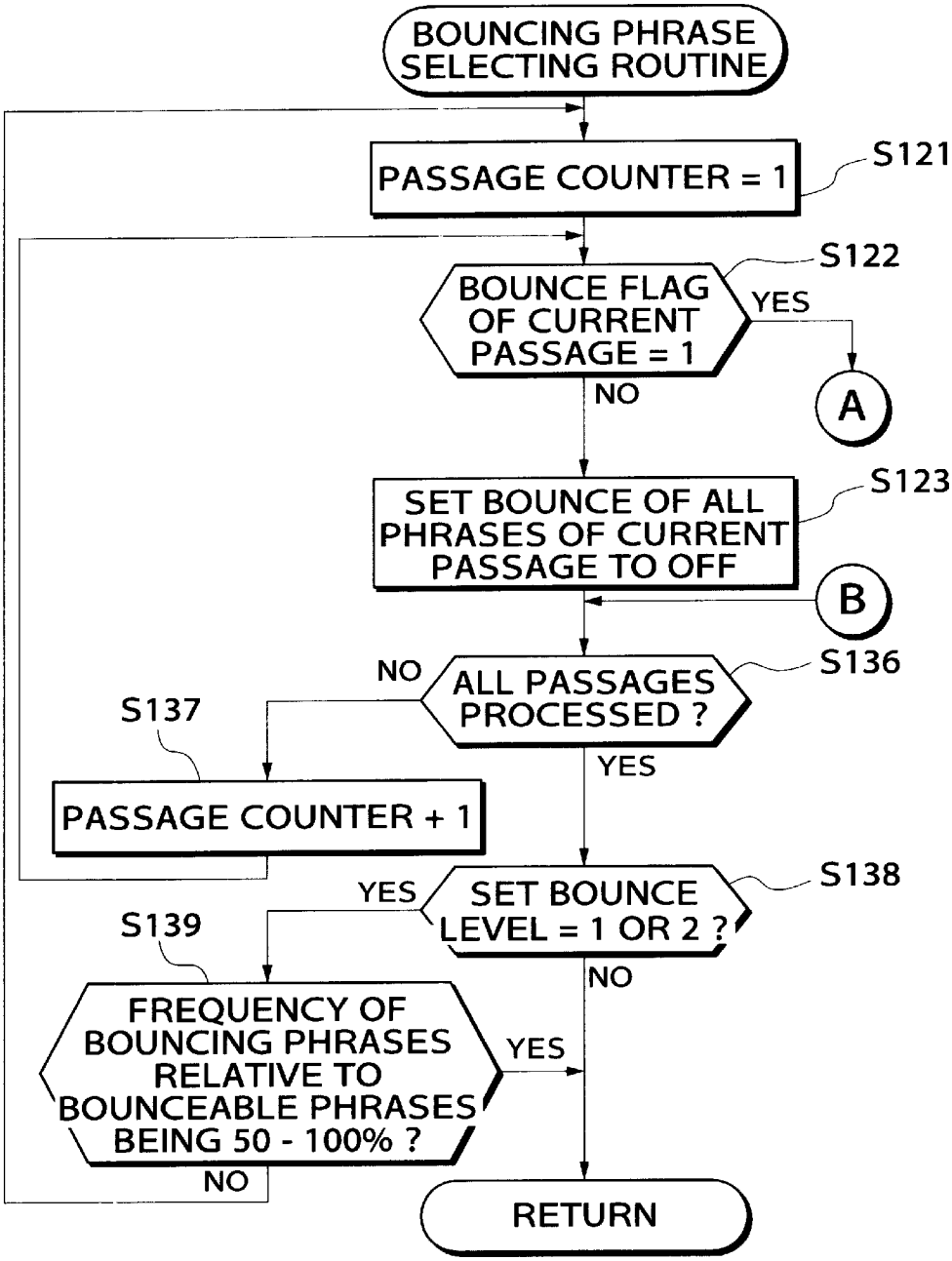
FIG. 19 is a flowchart showing in detail the flow of a bouncing phrase selecting subroutine of FIG. 17.

FIG. 19 and FIG. 20 is a flowchart showing in detail the flow of the bouncing phrase selecting subroutine of the above step S95 of FIG. 17.

In FIG. 19, step S121 is first executed to initialize the passage counter to "1", as in the above step S101.

Step S122 is then executed to determine whether the bounceable passage flag of the current passage is "1". When the bounceable passage flag is equal to 0, namely, when the current passage is not a bounceable passage, step S123 is executed to set the bounce of all phrases of the current phrase to "OFF", and the control flow goes to step S136. When the bounceable passage flag is equal to 1, on the other hand, the control flow goes to step S124 of FIG. 20.

The operations of steps S124 to S135 can be realized by replacing "passage" by "phrase" in the operations of the above steps S101 to S112 of FIG. 18, description of which is therefore omitted.

In step S136, it is determined whether the operations of steps S122 to S135 have been finished with respect to all of the passages in the piece of music. If an affirmative decision (YES) is obtained in step S136, step S137 is executed to increment the passage counter by "1", and the control flow returns to step S122 to repeat the above-described operations. If a negative decision (NO) is obtained in step S136, the control flow goes to step S138.

In step S138, it is determined whether the set bounce level is "1" or "2". If the set bounce level is equal to 1 or 2, step S139 is executed to determine whether the frequency of bouncing phrases that appear in all bounceable phrases is 50% or higher. If the frequency of the bouncing phrases is 50% or higher, the present bouncing phrase selecting subroutine is finished. If it is less than 50%, the control flow returns to step S121, and the above-described operations are repeated until the frequency becomes equal to or higher than 50%.

FIG. 23B is a table indicating, by way of example, bouncing phrases selected in the above routine, wherein hatched sections indicate bouncing phrases. In the example shown in FIG. 23B, the set level is set to "1", and therefore the frequency of bounding phrases relative to all bounceable phrases is selected to be 50% or higher.

Figure 21:
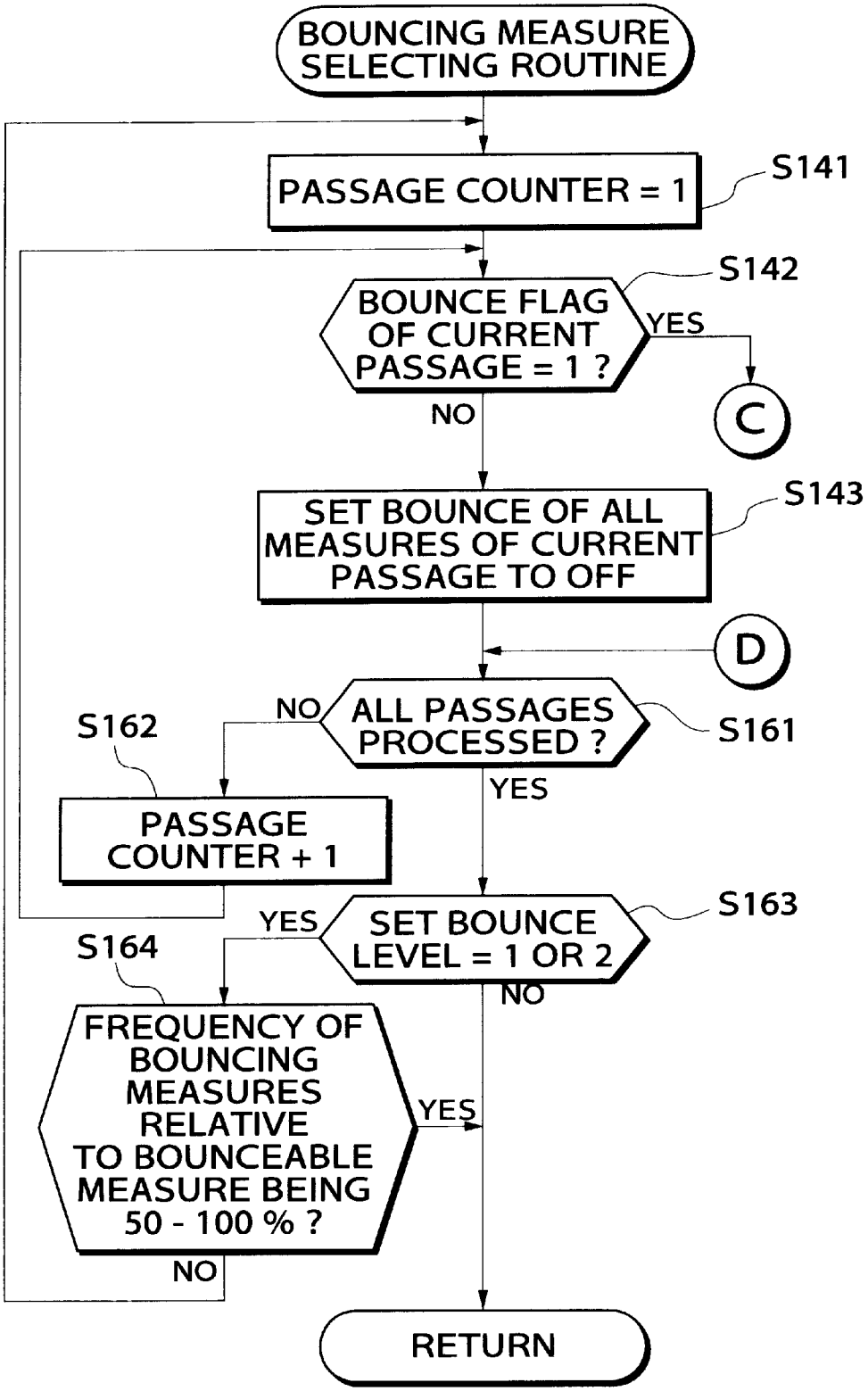
FIG. 21 is a flowchart showing in detail the flow of a bouncing measure selecting subroutine of FIG. 17.

FIG. 21 and FIG. 22 show a flowchart showing in detail the flow of the bouncing measure selecting subroutine of the above step S96 of FIG. 17.

In FIG. 21, step S141 is first executed to initialize the passage counter to "1" as in the above steps S101 and S102, and step S142 is determined whether the bounceable passage flag of the current passage is equal to "1" or not.

When step S142 determines that the bounceable passage flag is equal to 0, namely, when the current passage is not a bounceable passage, the bounce of all of the measures in the current passage is set to "OFF" in step S143, and the control flow goes to step S161. If the bounceable passage flag is equal to 1, the control flow goes to step S144 of FIG. 22.

In step S144, the phrase counter is initialized to "1" as in the above step S124, and step S145 is then executed to determine whether the bounceable phrase flag is equal to "1" or not. When the bounceable phrase flag is 0, namely, when the current phrase is not a bounceable phrase, the bounce of all measures of the current phrase is set to "OFF" in step S146, and the control flow goes to step S159. When the bounceable phrase flag is equal to 1, the control flow goes to step S147.

In step S147, a measure counter in the form of a soft counter provided in a certain region of the RAM 7 for counting measures is initialized to "1", and step S148 is then executed to determine whether the bounceable measure flag of the current measure is equal to "1" or not.

If step S148 determines that the bounceable measure flag is not equal to 1, the bounce of the current measure is set to "OFF" in step S149, and the control flow then goes to step S157. If the bounceable measure flag is equal to 1, the control flow goes to step S150.

In step S150, it is determined whether the passage containing the current measure is a same-name or similar passage. If it is the same-name or similar passage, step S151 is executed to set the "ON/OFF" of the bounce of the current measure to be equal to that of the corresponding measure of its reference passage, and the control flow goes to step S157. If the passage containing the current measure is not a same-name or similar passage, the control flow goes to step S152.

In step S152 through step S156, whether the current measure includes a bounce or not, i.e., whether the current measure is a bouncing measure or not, is determined according to the set bounce level and the rules of FIG. 16A. Namely, when the set bounce level is equal to 0, the bounce of the current measure is set to "OFF" (step S152→S154→S156). When the set bounce level is equal to 1 or 2, the "ON/OFF" of the bounce of the current measure is randomly determined (step S152→S153). When the set bounce level is equal to 3, the bounce of the current measure is set to "ON" (step S152→S154→S155).

In step S157, it is determined whether the operations of the above steps S148–S156 have been finished with respect to all of the measures in the current phrase. If any of the measures remains unprocessed, step S158 is executed to increment the measure counter by "1", and the control flow returns to step S148 to repeat the above-described operations. If all of the measures have been processed, the control flow goes to step S159.

In step S159, it is determined whether the operations of the above steps S145–S158 have been finished with respect to all of the phrases in the current passage. If any of the phrases remains unprocessed, step S160 is executed to increment the phrase counter by "1", and the control flow returns to step S145, to repeat the above-described operations. If all of the phrases have been processed, the control flow goes to step S161 of FIG. 21.

In step S161, it is determined whether the above steps S142–S160 have been finished with respect to all of the passages in the piece of music. If any of the passages remains unprocessed, step S162 is executed to increment the passage counter by "1", and the control flow returns to step S142 to repeat the above-described operations. If all of the operations have been finished with respect to all of the passages, the control flow goes to step S163.

In step S163, it is determined whether the set bounce level is equal to "1" or "2". If the set bounce level is equal to 1 or 2, step S164 is executed to determine whether the frequency of bouncing measures relative to all bounceable measures is 50% or higher.

If step S164 determines that the frequency of bouncing measures is less than 50%, the control flow returns to step S141, and the bouncing measure selecting routine is executed again. If the frequency of bouncing measures is 50% or higher, the present bouncing measure selecting routine is finished.

FIG. 23C is a table indicating, by way of example, the bouncing measures selected in the above routine, wherein the hatched sections in the bottom row indicate bouncing measures. In the example of FIG. 23C where the set level is set to "1", the frequency of the bouncing measures relative to all of the bounceable measures is selected to be 50% or higher.

As described above, the characteristics set for the whole piece of music are distributed among its passages, phrases and measures as needed according to the set levels thereof. Where rhythm patterns having different characteristics are to be obtained, only the characteristics of the whole piece of music may be changed, thus eliminating a need to set different characteristics to each passage, phrase or measure, respectively, assuring an improved operability or efficiency.

Figure 25:
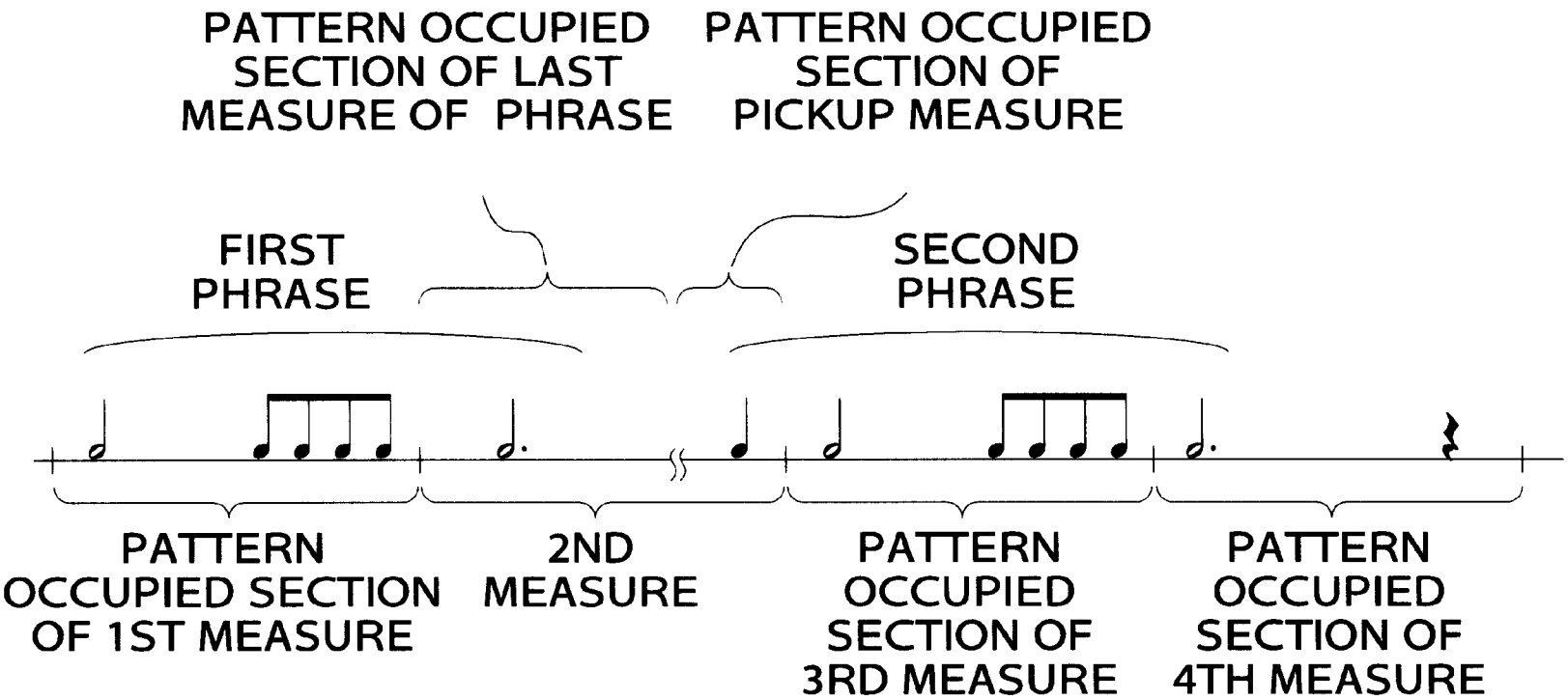
FIG. 25 is a view showing, for illustrative purpose only, rhythm pattern generation sections determined by the rhythm pattern generation section determining routine of FIG. 24.

Next, the rhythm pattern generating routine of the above step S13 of FIG. 5 will be briefly described, and the rhythm pattern generation section determining routine of the above step 12 executed before the rhythm pattern generating routine will be then described in detail referring to FIG. 24 and FIG. 25.

Rhythm patterns for the piece of music as a whole are generated in the following manner:

1) While a rhythm pattern is allocated to each measure in principle, namely, a rhythm pattern occupies the entire interval of each measure in principle, one measure may be divided into a plurality of pattern occupied sections that are determined as described later, when one rhythm pattern cannot be allocated to the whole measure as in the case where the measure is a pickup measure (a measure that has a leading part thereof included in the previous measure).
2) The rhythm patterns are allocated to the respective pattern occupied sections thus determined.
   a) Where the current passage is a same-name or similar passage, and the number of syllables in its reference measure (the same-number measure of the same-number phrase of the reference passage) is equal to that of the current measure, while the interval between the first tone-generation point and the last tone-generation point of the reference measure is within the pattern occupied section of the current measure, the rhythm pattern of the current measure is made identical with that of the reference measure.
   b) Where the current passage is a new passage or does not satisfy the conditions as indicated above at a), a rhythm pattern that best matches data relating to the current measure contained in the generated rhythm pattern characteristic link table is selected from the rhythm pattern database 34.
3) In the above manner, a rhythm pattern is allocated to each measure, to thereby generate rhythm patterns for the entire piece of music.

FIG. 24 is a flowchart showing in detail the flow of the rhythm pattern generation section determining routine for determining the pattern occupied sections of one piece of music.

In FIG. 24, step 171 is first executed to determine to initialize a measure counter to "1". The measure counter is in the form of a soft counter provided in a certain region of the RAM 7.

Step S172 is then executed to determine whether the current measure should be divided into a plurality of sections. If an affirmative decision (YES) is obtained in step S172, the position at which the current measure should be divided is determined according to the number of syllables contained in the current measure. If the current measure should not be divided into a plurality of sections, the control flow goes to step S174, skipping step S173.

Whether the current measure should be divided or not is determined as follows: In the present embodiment, as described above, a piece of music may contain normal measures and one or more pickup measures. The pickup measure is defined as a measure that is located at the top of a certain phrase, and includes a portion that is occupied by the last part of the previous phrase. Namely, the former half of the measure to be divided provides the last measure of the previous phrase, and the latter half provides the leading measure (=pickup measure) of the next phrase. Each phrase is provided with information indicative of the presence of a pickup measure and, if any, the number of syllables in the pickup measure, and whether the current measure is to be divided or not is determined based on this information.

The position at which the current measure is divided into a previous phrase section and a pickup section of the next phrase is determined in the following manner: The length of time or duration obtained by multiplying the number of notes in the pickup section (where the number of notes is odd, 1 is added to the odd number to provide an even number) by the length of eighth note is given to the pickup section, and the remaining length of time is given to the previous phrase section. For example, where the pickup section contains one note, the length of a fourth note (obtained by multiplying (1+1) by the length of eighth note) is given to the pickup section, and the remaining length of time (obtained by multiplying the length of a fourth note by 3) is given to the previous phrase section of the pickup measure. Where the shortest note of the rhythm pattern is sixteenth note, the length of time obtained by multiplying the number of note(s) by the length of sixteenth note may be given to the pickup section of the pickup measure.

In step S174, it is determined whether the operations of the above steps S172 and S173 have been finished with respect to all of the measures. If any of the measures remains unprocessed, step S175 is executed to increment the measure counter by "1", and the control flow goes to step S172 to repeat the above-described operations. If all of the measures have been processed, the control flow goes to step S176.

In step S176, the measure counter is initialized as in the above step S171, and step S177 is then executed to determine whether the current measure should be divided or not.

If step S177 determines that the current measure should be divided, step S178 is executed to determine whether the position at which the current measure is divided is located to the right (behind) the position of division of the same-number measure of the same-number phrase of a same-name or similar passage that is present before or after the current measure.

In step S179, the result of determination in step S178 is checked, and, if the position of division is located to the right, the position of division of the current measure is shifted to the left (forward) up to the position of division of the reference measure in step S180. It is, however, to be noted that the syllables allocated to the former half of the current measure should not override the minimum pattern occupied section (the length of the shortest note x the number of syllables). As a result of the operation of step S180, the position of division of the measure in the same-name or similar passage is made substantially the same as that of the reference measure.

If the position of division of the current measure is not located to the right as compared with the reference measure, the control flow goes to step S181 skipping step S180.

In step S181, it is determined whether the operations of the above steps S177–S180 have been finished with respect to all of the measures in the piece of music. If any of the measures remains unprocessed, step S182 is executed to increment the measure counter by "1", and the control flow returns to step S177. If all of the measures have been processed, the present rhythm pattern generation section determining routine is finished.

FIG. 25 shows one example of rhythm pattern generation sections determined by the rhythm pattern generation section determining routine as described above. In FIG. 26, the first, third and fourth measures are normal measures, and a selected rhythm pattern occupies the entire interval of each of these measures. The second measure, which is a pickup measure, is divided into two sections, i.e., the former half and the latter half, and a rhythm pattern selected for the last part of the first phrase is allocated to the former half section, while a rhythm pattern selected for the leading part of the second phrase is allocated to the latter half section.

In the present embodiment, as described above, the rhythm pattern is modified as desired by selecting one from a plurality of rhythm patterns having the same characteristics, and it is therefore easy to provide different rhythm patterns having the same characteristics.

The characteristic data indicating characteristics of each rhythm pattern in the rhythm pattern database 34 are not limited to the illustrated items, such as "the length of the initial tone", "syncopation", "bounce", "complexness", "anacrusis (unstressed note)" and "sense of ending", but may include more characteristics or less characteristics.

While the algorithm of the rhythm pattern generation section determining routine shown in FIG. 24 has been described above for illustrative purpose only, the present invention may employ other algorithms for determining the rhythm pattern generation sections.

Also, the set levels of the composition conditions and the rules as to how the conditions are applied to each passage, each phrase and each measure are not limited to those of the illustrated embodiment. While the frequency is selected at random from the range of 50% to 100% in the illustrated embodiment, the range of the frequency is not limited to 50% to 100%. Namely, the lower limit may be higher or lower than 50%, and the upper limit may be less than 100%.

It is to be understood that the object of the present invention may also be accomplished by supplying a system or an apparatus with a storage medium in which a software program that realizes the functions of the illustrated embodiment is recorded, and causing a computer (CPU 5 or MPU) of the system or apparatus to read out and execute the program stored in the storage medium.

In this case, the program itself read from the storage medium accomplishes the novel functions of the present invention, and thus the storage medium storing the program constitutes the present invention.

The storage medium for supplying the above-described program to the system or apparatus may be selected from a hard disc mounted in the HDD 11, CD-ROM 21, MO, MD, floppy disc 20, CD-R (CD-Recordable), magnetic tape, non-volatile memory card, ROM, and others. The program may also be supplied from other MIDI equipment 100, or the server computer 102 via the communication network 101.

The functions of the illustrated embodiment may be accomplished not only by executing a program read by a computer, but also by causing an operating system (OS) that operates on the computer, to perform a part or the whole of the actual operations according to instructions of the program.

Furthermore, the program read from the storage medium may be written into a memory provided in an expanded board inserted in the computer, or an expanded unit connected to the computer, and a CPU, or the like, provided in the expanded board or expanded unit may actually perform part or all of the operations according to the instructions of the program, so as to accomplish the functions of the illustrated embodiment.

What is claimed is:

1. An automatic composition apparatus comprising:

a rhythm pattern database comprising a plurality of rhythm patterns and characteristic data indicating characteristics of each of the rhythm patterns;

a setting device that establishes characteristics of a rhythm pattern of a piece of music to be composed, respectively, for a plurality of sectional elements that constitute the piece of music to be composed; and a selecting device that retrieves the characteristic data that match the characteristics established by said setting device, from said rhythm pattern database, and selects one of the rhythm patterns that corresponds to the retrieved characteristic data, for each sectional element, thereby generating a rhythm pattern of a melody of the piece of music to be composed.

2. An automatic composition apparatus according to claim 1, wherein the characteristics of each of the rhythm patterns comprise at least information indicating a number of tone-generation points of said each rhythm pattern, and, when said setting device changes the number of tone-generation points in the piece of music to be composed, said selecting device selects, from said rhythm pattern database, a rhythm pattern whose number of tone-generation points is equal to that after being changed, and which has characteristic data indicating at least one characteristic other than the number of tone generation points, which data are approximate to those of an original rhythm pattern before said setting device changes the number of tone-generation points.

3. An automatic composition apparatus according to claim 1, wherein each of said plurality of rhythm patterns stored in said rhythm pattern database represents a rhythm pattern of one measure, said automatic composition apparatus further comprising:

a measure dividing device that divides a measure in question in the piece of music to be composed into a first section associated with a previous measure that immediately precedes the measure in question, and a second section associated with a measure that immediately follows the measure in question, when a single rhythm pattern cannot be allocated to the measure in question in the piece of music, and wherein said selecting device selects different rhythm patterns for said first section and said second section, respectively.

4. An automatic composition apparatus as claimed in claim 1, wherein the characteristics include at least one of initial tone length, syncopation, bounce, sense of ending, and complexity.

5. An automatic composition method comprising the steps of:

providing a rhythm pattern database comprising a plurality of rhythm patterns and characteristic data indicating characteristics of each of the rhythm patterns;

establishing characteristics of a rhythm pattern of a piece of music to be composed, respectively, for a plurality of sectional elements that constitute the piece of music to be composed;

retrieving the characteristic data that match the established characteristics from said rhythm pattern database; and selecting one of the rhythm patterns that corresponds to the retrieved characteristic data, for each sectional element, thereby generating a rhythm pattern of a melody of the piece of music to be composed.

6. An automatic composition method as claimed in claim 5, wherein the characteristics include at least one of initial tone length, syncopation, bounce, sense of ending, and complexity.

7. A storage medium storing program that is executable by a computer, comprising:

a setting module that establishes characteristics of a rhythm pattern of a piece of music to be composed, respectively, for a plurality of sectional elements that constitute the piece of music to be composed; and a selecting module that retrieves characteristic data that match the characteristics established by said setting module, from a rhythm pattern database comprising a plurality of rhythm patterns and characteristic data indicating characteristics of each of the rhythm patterns, and selects one of the rhythm patterns that corresponds to the retrieved characteristic data, for each sectional element, thereby generating a rhythm pattern of a melody of the piece of music to be composed.

8. A storage medium storing program as claimed in claim 7, wherein the characteristics include at least one of initial tone length, syncopation, bounce, sense of ending, and complexity.

9. An automatic composition apparatus comprising:

a rhythm pattern database comprising a plurality of rhythm patterns, and characteristic data indicating characteristics of each of said rhythm patterns;

an attaching device that attaches a rhythm pattern to a piece of music to be composed; and a determining device that sequentially compares the rhythm pattern to be attached to the piece of music with each of the rhythm patterns in the rhythm pattern database, reads out, when the rhythm patterns thus compared coincide with each other, characteristic data corresponding to the rhythm pattern in the rhythm pattern database, from the rhythm pattern database, and determines the read out characteristic data as characteristic data of the rhythm pattern to be attached to the piece of music.

10. An automatic composition apparatus as claimed in claim 9, wherein the characteristics include at least one of initial tone length, syncopation, bounce, sense of ending, and complexity.

11. An automatic composition method comprising the steps of:

providing a rhythm pattern database comprising a plurality of rhythm patterns, and characteristic data indicating characteristics of each of said rhythm patterns;

attaching a rhythm pattern to a piece of music to be composed;

sequentially comparing the rhythm pattern to be attached to the piece of music with each of the rhythm patterns in the rhythm pattern database, reading out, when the rhythm patterns thus compared coincide with each other, characteristic data corresponding to the rhythm pattern in the rhythm pattern database, from the rhythm pattern database; and determining the read out characteristic data as characteristic data of the rhythm pattern to be attached to the piece of music.

12. An automatic composition method as claimed in claim 11, wherein the characteristics include at least one of initial tone length, syncopation, bounce, sense of ending, and complexity.

13. A storage medium storing program that is executable by a computer, comprising:

a determining module that searches a rhythm pattern database comprising a plurality of rhythm patterns, and characteristic data indicating characteristics of each of said rhythm patterns, so as to sequentially compare the rhythm pattern to be attached to the piece of music with each of the rhythm patterns in the rhythm pattern database, read out, when the rhythm patterns thus compared coincide with each other, characteristic data corresponding to the rhythm pattern in the rhythm pattern database, from the rhythm pattern database, and determines characteristic data as characteristic data of the rhythm pattern to be attached to the piece of music.

14. A storage medium storing program as claimed in claim 13, wherein the characteristics include at least one of initial tone length, syncopation, bounce, sense of ending, and complexity.

* * * * *